US011173413B2

(12) United States Patent
Ishimatsu

(10) Patent No.: US 11,173,413 B2
(45) Date of Patent: Nov. 16, 2021

(54) BLOCK MEMBER SET

(71) Applicant: TAKAHARA LUMBER CO., LTD., Kumamoto (JP)

(72) Inventor: Shingo Ishimatsu, Kumamoto (JP)

(73) Assignee: TAKAHARA LUMBER CO., LTD., Kumamoto (JP)

( * ) Notice: Subject to any disclaimer, the term of this patent is extended or adjusted under 35 U.S.C. 154(b) by 0 days.

(21) Appl. No.: 17/051,586

(22) PCT Filed: Feb. 20, 2020

(86) PCT No.: PCT/JP2020/006818
§ 371 (c)(1),
(2) Date: Oct. 29, 2020

(87) PCT Pub. No.: WO2020/175318
PCT Pub. Date: Sep. 3, 2020

(65) Prior Publication Data

US 2021/0154590 A1 May 27, 2021

(30) Foreign Application Priority Data

Feb. 27, 2019 (JP) ..... JP2019-033796

(51) Int. Cl.
*A63H 33/00* (2006.01)
*A63H 33/08* (2006.01)

(52) U.S. Cl.
CPC ..... *A63H 33/086* (2013.01)

(58) Field of Classification Search
CPC ..... A63H 33/086; E04B 2/48; E04B 2/18; E04C 1/395; E02D 17/205
(Continued)

(56) References Cited

U.S. PATENT DOCUMENTS 2,885,822 A * 5/1959 Onanian ..... A63H 33/101 446/121
3,005,282 A * 10/1961 Christiansen ..... A63H 33/086 446/128

(Continued)

FOREIGN PATENT DOCUMENTS

JP S45-032835 Y1 12/1970
JP S51-094798 U1 7/1976

(Continued)

OTHER PUBLICATIONS

ISR for PCT/JP2020/006818 dated May 12, 2020.

*Primary Examiner* — Eugene L Kim
*Assistant Examiner* — Matthew B Stanczak
(74) *Attorney, Agent, or Firm* — Greenblum & Bernstein, P.L.C.

(57) ABSTRACT

A block member set includes a plurality of box-shaped block bodies each having an open bottom surface, a plurality of flat-plate-shaped joint members, and a plurality of box-shaped joint members, wherein each of the plurality of flat-plate-shaped joint member placed on an upper surface of each of the plurality of box-shaped block body and each of plurality of the box-shaped joint member accommodated in the box-shaped block body are connected to each other by a rod-shaped connecting member which passes through an insertion hole formed in the box-shaped block body thus being integrally formed with each other and forming a block.

12 Claims, 15 Drawing Sheets

(58) Field of Classification Search
USPC ..... 52/606–607, 220.2, 286, 505, 582.1
See application file for complete search history.

(56) References Cited

U.S. PATENT DOCUMENTS 3,180,059 A * 4/1965 Persak, Jr. ..... E04B 2/18 52/592.6
3,234,683 A * 2/1966 Christiansen ..... A63H 33/065 446/103
3,346,775 A * 10/1967 Christiansen ..... A63H 33/042 361/738
4,176,493 A * 12/1979 Dideriksen ..... A63H 33/042 446/102
D255,039 S * 5/1980 Gale ..... 446/124
4,740,189 A * 4/1988 Bertrand ..... A63H 33/086 446/102
4,757,656 A * 7/1988 Powers, Jr. ..... E04C 3/02 52/204.2
4,883,440 A * 11/1989 Bolli ..... A63H 33/042 446/91
5,411,428 A * 5/1995 Orii ..... A63H 33/042 446/102
5,471,808 A * 12/1995 De Pieri ..... E04B 2/18 52/603
6,086,444 A * 7/2000 Glickman ..... A63H 33/08 446/120
6,126,506 A * 10/2000 Rudy ..... A63H 19/30 446/124
6,146,721 A * 11/2000 Freynet ..... A47G 33/08 273/155
6,161,357 A * 12/2000 Altemus ..... E04B 2/18 446/124
6,648,714 B1 * 11/2003 Kuo ..... A63H 33/065 446/120
6,736,691 B1 * 5/2004 Bach ..... A63H 33/101 446/128
6,805,605 B2 * 10/2004 Reining ..... A63H 33/086 446/484
6,996,945 B2 * 2/2006 Doty ..... E04B 2/18 52/582.1
7,347,028 B1 * 3/2008 Bin-Nun ..... A63H 33/086 446/112
7,823,858 B2 * 11/2010 Matsufuji ..... B28B 13/0275 249/151
8,495,850 B1 * 7/2013 Lin ..... E04B 2/18 52/592.6
8,888,552 B2 * 11/2014 Wizenberg ..... A63H 33/086 446/102
8,920,207 B2 * 12/2014 Hageman ..... A63H 33/086 446/124
9,017,133 B2 * 4/2015 Rolf ..... A63H 33/086 446/118
9,689,160 B2 * 6/2017 Lanese ..... E04B 2/08
9,814,997 B1 * 11/2017 Vaillancourt ..... A63H 33/086
9,901,841 B2 * 2/2018 Ryaa ..... A63H 33/04
10,010,805 B2 * 7/2018 Maxam ..... A63J 1/02
10,596,480 B1 * 3/2020 Samo ..... A63H 33/086
10,646,791 B2 * 5/2020 Semling ..... A63H 33/088
10,781,588 B1 * 9/2020 Nadeau ..... E04C 5/08
2003/0029119 A1 * 2/2003 Coleman ..... E04B 2/10 52/604
2004/0020145 A1 * 2/2004 Matsufuji ..... E04B 2/42 52/223.7
2008/0098687 A1 * 5/2008 Marsh ..... E04B 2/16 52/606
2010/0210173 A1 * 8/2010 Maggiore ..... A63H 33/086 446/125
2012/0071061 A1 * 3/2012 Smith ..... A63H 33/086 446/128
2013/0072082 A1 * 3/2013 Wizenberg ..... A63H 33/086 446/85
2013/0237120 A1 * 9/2013 Haner ..... A63B 67/06 446/153
2013/0312357 A1 * 11/2013 Lin ..... A63H 33/106 52/589.1
2015/0075106 A1 * 3/2015 Vandenbempt ..... E04B 2/18 52/596
2015/0321114 A1 * 11/2015 Broyles ..... A63H 33/14 446/124
2016/0199750 A1 * 7/2016 Yamagishi ..... A63H 33/086 144/364
2016/0279534 A1 * 9/2016 Chang ..... A63H 33/065
2019/0022543 A1 * 1/2019 Takeda ..... A63H 33/086
2019/0232186 A1 * 8/2019 Wong ..... A63H 17/262
2019/0299113 A1 * 10/2019 Lee ..... A63H 33/086
2019/0358558 A1 * 11/2019 Barwald ..... A63H 33/086
2020/0054957 A1 * 2/2020 Chan ..... A63H 33/08
2020/0147509 A1 * 5/2020 Deng ..... A63H 33/08
2020/0246717 A1 * 8/2020 Evics ..... A63H 33/062
2020/0282323 A1 * 9/2020 MacArthur ..... A63H 33/102
2021/0268396 A1 * 9/2021 Porter ..... A63H 33/086

FOREIGN PATENT DOCUMENTS

JP S55-012975 U1 1/1980
JP S56-168775 A 12/1981
JP S57-070397 U1 4/1982
JP H08-071258 A 3/1996
JP 2016-168348 A 9/2016
WO WO 2005/094182 A2 10/2005

* cited by examiner (a)

(b)

(a)

(b)

(a)

(b)

(a)

(b)

(a)

(b)

(a)

(b)

(a)

(b)

(c)

(a)

(b)

(c)

BLOCK MEMBER SET

TECHNICAL FIELD

The present invention relates to a block member set where one block which enables the manufacture of various structural bodies by integrally forming a plurality of block members into one block and by assembling such integrally formed blocks.

BACKGROUND ART

Currently, a large amount of thinned wood and wood waste which are residues after lumbering are incinerated. Although there has been a movement to make use of these thinned wood and waste wood for biomass power generation and the like, to reduce $CO_2$ which is one of causes of recent global warming, it is important not to release carbon to the atmosphere but to keep carbon in a solid state, and it is desirable to keep using wood as it is.

On the other hand, conventionally, there have been well-known blocks which can produce (assemble) various structural bodies by assembling a plurality of blocks. As such a block, for example, there has been known a block having an upper surface on which a projection is formed, an inner space in which a recess corresponding to the projection is formed, and an open bottom surface. With respect to such a block, there have been proposed blocks which use various raw materials. Besides a block which uses a synthetic resin (see patent literature 1), a block which uses wood (see patent literature 2) are also proposed.

CITATION LIST

Patent Literatures

[Patent Literature 1] Japanese Patent Laid-Open Publication No. 08-071258

[Patent Literature 2] Japanese Patent Laid-Open Publication No. 2016-168348

SUMMARY OF INVENTION

Technical Problem

In the above-mentioned conventional block, usually, sizes of a projection and a recess of a block, the numbers of projections and recesses and the like are decided corresponding to (in proportion to) a size of a standard block of a block set, and a block is manufactured by taking into account shapes of the projection and the recess. Accordingly, in one block set, a block which largely differs in size compared to a size of the standard block is not usually included. Further, even in the case where plural kinds of blocks which differ from each other in size and shape are manufactured, an expensive die becomes necessary for accurately molding a projection and a recess and the like. Accordingly, under the current circumstances, a variation of blocks is limited.

Further, usually, the conventional block has a projection and a recess and hence, the projection and the recess are exposed to an outermost surface of a structural body formed by assembling a plurality of blocks to each other. Accordingly, there arises a drawback that an aesthetic appearance of the structural body is impaired. To overcome such a drawback, in some fields, a block having only projections or recesses has been manufactured lately. However, in the same manner as the above-mentioned block, the variation of such a block is extremely limited.

As a result, the variation of a structural body which can be manufactured using blocks of a block set has been limited.

Accordingly, it is an object of the present invention to provide a novel block member set which can form blocks in various variations using small kinds of members, and can manufacture various structural bodies by assembling these blocks.

It is another object of the present invention to provide a block member set which can manufacture a structural body where neither a projection portion nor a recess is exposed on an outermost surface when the structural body is manufactured by assembling a plurality of blocks.

Solution to Problem

As a result of intensive studies to solve the above-mentioned problems, the inventors of the present invention have found that the above-mentioned problems can be solved by providing a block body, a projection and a recess as separated members and by forming one block by integrally forming the respective members with each other, and have achieved the present invention.

That is, the present invention is as follows.

[1] A block member set comprising a plurality of box-shaped block bodies each having an open bottom surface, a plurality of flat-plate-shaped joint members, and a plurality of box-shaped joint members, wherein each of the plurality of flat-plate-shaped joint member placed on an upper surface of each of the plurality of box-shaped block body and each of plurality of the box-shaped joint member accommodated in the box-shaped block body are connected to each other by a rod-shaped connecting member which passes through an insertion hole formed in the box-shaped block body thus being integrally formed with each other and forming a block, wherein at least one of the plurality of flat-plate-shaped joint members is a projection-attached flat-plate-shaped joint member having a projection on an upper surface thereof, and at least one of the plurality of the box-shaped joint members is a box-shaped recessed joint member which has an open bottom surface and in which a recess which engages with the projection of the projection-attached flat-plate-shaped joint member by fitting is formed.

[2] The block member set according to [1], wherein the rod-shaped connecting member is mounted on a lower surface of the flat-plate-shaped joint member, and the rod-shaped connecting member is made to engage by fitting with and to be fixed to a fitting engagement hole formed in the box-shaped joint member so that a block where the box-shaped body, the flat-plate-shaped joint member and the box-shaped joint member are integrally formed with each other is formed.

[3] The block member set according to [2], wherein two rod-shaped connecting members are formed on the lower surface of the flat-plate-shaped joint member.

[4] The block member set according to [2], wherein one rod-shaped connecting member is formed on a corner of the lower surface of the flat-plate-shaped joint member.

[5] The block member set according to [4], wherein two or more insertion holes of the box-shaped block body and two or more fitting engagement holes of the box-shaped joint member are formed in corners of upper plates of the box-shaped block body and in corners of upper plates of the box-shaped joint member respectively.

[6] The block member set according to any one of [1] to [5], wherein at least one of the plurality of flat-plate-shaped joint members is a flat-plate-shaped planar joint member having a flat upper surface.

[7] The block member set according to any one of [1] to [6], wherein at least one of plurality of box-shaped joint members is a box-shaped planar joint member having a flat lower surface.

[8] The block member set according to any one of [1] to [7], wherein an accommodating recess which accommodates a flat plate portion of the flat-plate-shaped joint member is formed on an upper surface of the box-shaped block body.

[9] The block member set according to any one of [1] to [8], wherein the box-shaped block body and the box-shaped joint member respectively are shaped so as to accommodate the flat-plate-shaped joint member disposed on the upper surface of another block therein in assembling the block to an upper portion of the another block by stacking.

[10] The block member set according to any one of [1] to [9], wherein the box-shaped block body is made from wood.

[11] The block member set according to any one of [1] to [10], wherein the flat-plate-shaped joint member and the box-shaped joint member are made from a synthetic resin.

[12] A block comprising a box-shaped block body having an open bottom surface, a flat-plate-shaped joint member, and a box-shaped joint member, wherein the flat-plate-shaped joint member placed on an upper surface of the box-shaped block body and the box-shaped joint member accommodated in the box-shaped block body are connected with each other by a rod-shaped connecting member which passes through an insertion hole formed in the box-shaped block body thus being integrally formed with each other and forming the block.

Advantageous Effects of Invention

According to the block member set of the present invention, blocks of various variations can be formed using small kinds of members, and various structural bodies can be manufactured by assembling these blocks. Further, it is possible to provide a structural body where a projection and a recess are not exposed to an outermost surface at the time of manufacturing a structural body by assembling a plurality of blocks to each other.

DESCRIPTION OF EMBODIMENTS

Figure 1:
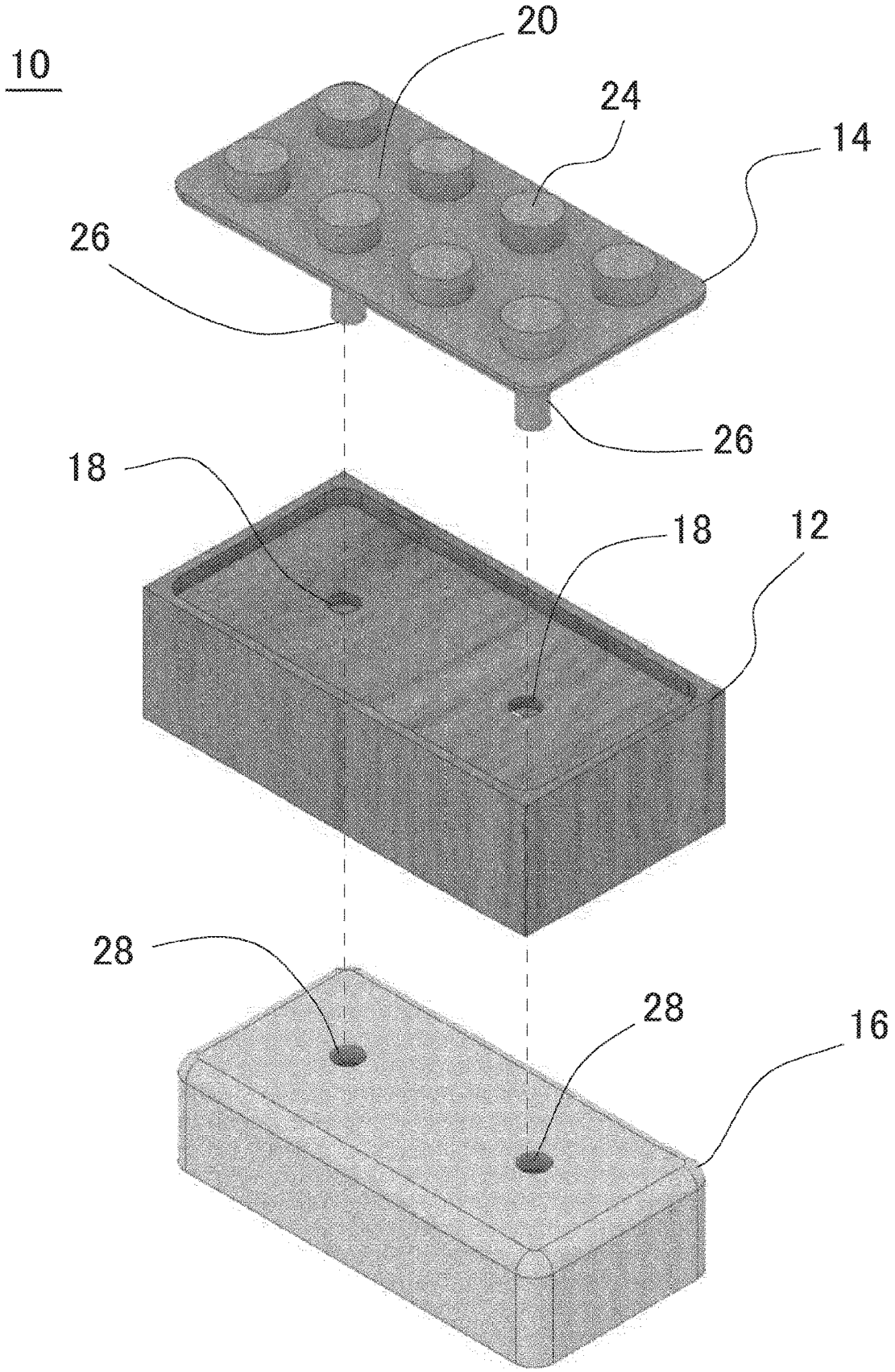
FIG. 1 is a perspective view of block members of a block member set according to a first embodiment of the present invention (a state before the block members are integrally formed so as to form a block).

A block member set according to the present invention includes a plurality of box-shaped block bodies each having an open bottom surface, a plurality of flat-plate-shaped joint members, and a plurality of box-shaped joint members. Each of the plurality of flat-plate-shaped joint member placed on an upper surface of each of the plurality of box-shaped block body and each of plurality of the box-shaped joint member accommodated in the box-shaped block body are connected to each other by a rod-shaped connecting member which passes through an insertion hole formed in the box-shaped block body thus being integrally formed with each other and forming a block. At least one of the plurality of flat-plate-shaped joint members is a projection-attached flat-plate-shaped joint member having a projection on an upper surface thereof. At least one of the plurality of the box-shaped joint members is a box-shaped recessed joint member which has an open bottom surface and in which a recess which engages with the projection of the projection-attached flat-plate-shaped joint member by fitting is formed.

According to the block member set of the present invention, blocks having various shapes can be manufactured by assembling and integrally forming the box-shaped block body, the flat-plate-shaped joint member, and the box-shaped joint member. For example, it is possible to manufacture blocks having various shapes using a plural kinds of box-shaped block bodies which differ from each other in size and shape, one kind of flat-plate-shaped joint member, and one kind of box-shaped joint member. By using the blocks having various shapes, a wide variety of structural bodies can be manufactured. By forming the flat-plate-shaped joint member and the box-shaped joint member into particular shapes respectively, in this structural body, the projection and the recess are not exposed to the outermost surface of the structural body.

The block member set of the present invention having such a configuration can be used as an assembling-type block toy, a pen stand, stationery such as a pen case, or an interior article such as an ornament. Further, a block member set which includes a relatively large box-shaped block body can be used for manufacturing a gardening tool such as a flowerpot, a planter or a flower bed, and can be also used for manufacturing a furniture such as a rack.

Firstly, the box-shaped block body in the block member set of the present invention is described.

The box-shaped block body is a box body having an open bottom surface, and forming an inner space by an upper surface and side surfaces thereof. A shape of the box-shaped block body is not particularly limited provided that the box-shaped block body is formed of a box body having an open bottom surface, for example, a rectangular prismatic body, a cubic body, a cylindrical body, a prismatic body and the like can be named Usually, an outer profile (shape) of the box-shaped block body forms an outer profile of a block. That is, by changing an outer profile of the box-shaped block body, a shape of a block can be changed.

It is preferable that the box-shaped block body accommodate a box-shaped joint member, and be formed into a size having a larger width and a larger height than the box-shaped joint member. The size of the box-shaped block body can be suitably set depending on a usage. For example, in a case where the box-shaped block body is used for manufacturing a relatively small object such as an assembling-type block toy or the like, it is preferable that a width of the box-shaped block body be set to 5 to 500 mm inclusive, and a height of the box-shaped block body be set to 5 to 500 mm inclusive. It is more preferable that the width be set to 10 to 300 mm inclusive, and the height be set to 10 to 300 mm inclusive. It is further more preferable that the width be set to 10 to 100 mm inclusive, and the height be set to 10 to 100 mm inclusive. Further, in a case where the box-shaped block body is used for manufacturing a relatively large object such as a gardening tool or a furniture, it is preferable that the width be set to 50 to 3000 mm inclusive, and the height be set to 50 to 3000 mm inclusive, it is more preferable that the width be set to 100 to 2000 mm inclusive, and the height be set to 100 to 2000 mm inclusive. It is further more preferable that the width be set to 100 to 1000 mm inclusive, and the height be set to 100 to 1000 mm inclusive. The width of the box-shaped block body of the present invention means a length on a longer side. That is, in a case where the box-shaped block body has a rectangular shape, the width means a length of a long side, and in a case where the box-shaped block body has an elliptical shape, the width means a length of a long diameter.

It is preferable that the box-shaped block body be made from an easily moldable material, for example, as the material of the box-shaped block body, wood, a synthetic resin, metal or the like can be named. From a viewpoint of effective use of resources, it is preferable to use wood, and it is more preferable to use thinned wood or wood waste. As the wood used in the present invention, a kind of the wood is not limited, for example, either wood made from a broadleaf tree or wood made from a coniferous tree may be used. To be more specific, Japanese cedar, Japanese cypress, cypress, Japanese larch, Japanese red pine, Japanese black pine, Yeddo spruce, Abies sachalinensis and the like can be named. The box-shaped block body of the present invention includes neither a projection nor a recess, and hence, machining accuracy is not required compared to a conventional wood-made block having a projection or a recess. Accordingly, the box-shaped block body can be manufactured using not only wood made from a broadleaf tree having high hardness or wood to which compression hardening is applied but also soft wood made from a coniferous tree such as Japanese cedar can be used.

With respect to the conventional block which is entirely made from wood, it is difficult to ensure the machining accuracy due to a shrinkage of the wood caused by drying corresponding to the increase of a size of the block. It has been particularly difficult to form a projection and a recess on the block. However, the box-shaped block body of the present invention has the simple structure and hence, the box-shaped block body of the present invention can be easily manufactured.

The box-shaped block body has an insertion hole into which a rod-shaped connecting member for connecting a flat-plate-shaped joint member placed on an upper surface of the box-shaped block body and a box-shaped joint member accommodated in the box-shaped block body to each other is inserted. Usually, it is sufficient that the insertion hole is formed in an upper plate of the box-shaped block body in a penetrating manner, and the number of insertion holes is equal to or more than the number of rod-shaped connecting members. For example, in a case where one rod-shaped connecting member is formed on a corner of a lower surface of the flat-plate-shaped joint member, it is sufficient that one insertion hole is formed at a position (corner) of the upper plate of the box-shaped block body corresponding to the rod-shaped connecting member. However, two or more insertion holes may be formed on the corners of the upper plate of the box-shaped block body. For example, in a case where the box-shaped block body has a rectangular shape as viewed in a plan view, the insertion hole can be formed at two corners in a spaced-apart manner in a long side direction or in a diagonal direction. With such a configuration, the different flat-plate-shaped joint members, the number of which corresponds to the number of the insertion holes, can be mounted on the box-shaped block body and hence, a plurality of blocks can be stacked simultaneously. In this case, fitting engagement holes are formed in the box-shaped joint member at positions corresponding to the insertion holes.

In the box-shaped block body, although the upper surface of the box-shaped block body may be formed into a flat planar surface, it is preferable that an accommodating recess which accommodates a flat plate portion of the flat-plate-shaped joint member be formed on the upper surface. With such a configuration, when the flat plate portion of the flat-plate-shaped joint member is placed on the upper surface of the box-shaped block body, the flat plate portion of the flat-plate-shaped joint member is accommodated in the accommodating recess and hence, an upper surface of the block can be formed into a flat surface having no stepped portion.

Further, it is preferable that the box-shaped block body and the box-shaped joint member respectively are shaped so as to accommodate a flat-plate-shaped joint member disposed on an upper surface of another block therein in assembling the block to an upper portion of another block by stacking. That is, it is preferable that the box-shaped block body and the box-shaped joint member be formed into a shape where a peripheral edge of a lower end (a portion forming a peripheral edge of an opening surface) of the box-shaped block body is brought into contact with and is placed on an upper surface of another block without forming a gap therebetween. With such a configuration, in an external appearance, there is no possibility that the flat-plate-shaped joint member is exposed through a gap formed between the block and another block thus providing a block member set which exhibits an excellent aesthetic appearance. Further, it is unnecessary to form the above-mentioned accommodating recess on the upper surface of the box-shaped block body.

Next, the flat-plate-shaped joint member of the present invention is described.

The flat-plate-shaped joint member has a flat-plate-shaped flat plate portion which can be placed on the upper surface of the box-shaped block body.

A material of the flat-plate-shaped joint member is not particularly limited provided that the flat-plate-shaped joint member is made from a rigid material by which the flat-plate-shaped joint member can be easily molded while not being easily deformed. For example, as a material of the flat-plate-shaped joint member, materials such as wood, a synthetic resin, metal and the like can be named. Since a synthetic resin and metal exhibit excellent easy moldability and durability, the synthetic resin and metal are preferably used. From a viewpoint of low cost of a synthetic resin, the use of a synthetic resin is more preferable. As a synthetic resin, for example, an ABS resin, a styrol resin, a polyethylene resin, a polypropylene resin can be named. As metal, for example, stainless steel can be named.

The conventional wooden block is entirely made from wood and hence, forming of a projection is particularly difficult for preventing the occurrence of a shrinkage or a crack during a drying treatment. However, the flat-plate-shaped joint member of the present invention is manufactured using a synthetic resin or metal, it is possible to easily form a projection on the flat-plate-shaped joint member. Further, the flat-plate-shaped joint member is made from a synthetic resin or metal and hence, there is no possibility that wear and deformation occur on the flat-plate-shaped joint member. Accordingly, the flat-plate-shaped joint member can be used for a long period.

At least one of the flat-plate-shaped joint members of the block member set of the present invention is a projection-attached flat-plate-shaped joint member having a projection on an upper surface of the joint member. The projection is not particularly limited provided that the projection is formed in an engageable manner with a recess of a box-shaped joint member by fitting. For example, a projection having a circular columnar shape, a projection having a rectangular prismatic shape or the like can be named. Further, the number of the projections is not particularly limited and can be suitably set depending on a size and a usage of a block member set. For example, two to twelve projections may be used.

In the block member set of the present invention, all flat-plate-shaped joint member may be formed of the above-mentioned projection-attached flat-plate-shaped joint member. However, it is preferable that the flat-plate-shaped joint members include a flat-plate-shaped planar joint member having no projection on an upper surface thereof in addition to the projection-attached flat-plate-shaped joint members. As the flat-plate-shaped planar joint member of the present invention, for example, a planar joint member an upper surface of which is formed into a flat surface shape can be named (see FIG. 6). By arranging the flat-plate-shaped planar joint member on an outer surface of a structural body which is manufactured by assembling the blocks, it is possible to provide a structural body of a design having excellent aesthetic appearance by which a viewer cannot easily recognize at a glance that the structural body is manufactured using blocks.

Next, the box-shaped joint member of the present invention is described.

The box-shaped joint member is a box-shaped member which can be accommodated in the box-shaped block body.

A material of the box-shaped joint member is not particularly limited provided that the box-shaped joint member is made from a rigid material by which the box-shaped joint member can be easily molded while not being easily deformed. For example, as a material of the box-shaped joint member, materials such as wood, a synthetic resin, metal and the like can be named Since a synthetic resin and metal exhibit excellent easy moldability and durability, the synthetic resin and metal are preferably used. From a viewpoint of low cost of a synthetic resin, the use of a synthetic resin is more preferable. As a synthetic resin, for example, an ABS resin, a styrol resin, a polyethylene resin, a polypropylene resin can be named. As metal, for example, stainless steel can be named.

The conventional wooden block is entirely made from wood and hence, forming of a recess is particularly difficult for preventing the occurrence of a shrinkage or a crack during a drying treatment. However, the box-shaped joint member of the present invention is manufactured using a synthetic resin or metal, it is possible to easily form a recess on the box-shaped joint member. Further, the box-shaped joint member is made from a synthetic resin or metal and hence, there is no possibility that wear and deformation occur on the box-shaped joint member. Accordingly, the box-shaped joint member can be used for a long period.

At least one of the box-shaped joint members in the block member set of the present invention is a box-shaped recessed joint member having an open bottom surface and having a recess which is engageable with the projection of the projection-attached flat-plate-shaped joint member by fitting in the box-shaped recessed joint member. The recess is not particularly limited provided that the projection of the projection-attached flat-plate-shaped joint member can engage with the recess by fitting. For example, as the recess, an opening or a recess which corresponds to a transverse cross-sectional shape of the projection, or an inner space which is formed between a partition portion formed in the box-shaped recessed joint member and a side surface of the box-shaped recessed joint member and corresponds to a transverse cross-sectional shape of the projection can be named. To be more specific, as the recess of the box-shaped recessed joint member, an inner spaces formed between outer peripheral surfaces of a plurality of cylindrical partition portions formed in the box-shaped recessed joint member and an inner side surface of the box-shaped recessed joint member can be named.

In the block member set of the present invention, all box-shaped joint members may be formed of the above-mentioned box-shaped recessed joint member. However, it is preferable that the box-shaped joint members include a box-shaped planar joint member, a lower surface of which is flat, besides the box-shaped recessed joint members. As the box-shaped planar joint member of the present invention, a member, a bottom surface of which is not opened and is formed into a flat surface shape can be named, for example (see FIG. 7). By arranging the box-shaped planar joint member on an outer surface of a structural body manufactured by assembling blocks, it is possible to provide a structural body of a design having excellent aesthetic appearance by which a viewer cannot easily recognize at a glance that the structural body is manufactured using blocks.

Next, the rod-shaped connecting member of the present invention is described.

The rod-shaped connecting member is a member for connecting the flat-plate-shaped joint member placed on the upper surface of the box-shaped block body and the box-shaped joint member accommodated in the box-shaped block body to each other through the insertion hole formed in the box-shaped block body. The rod-shaped connecting member may be mounted on and integrally formed with the flat-plate-shaped joint member or the box-shaped joint member, or may be formed as a member separate from the flat-plate-shaped joint member and the box-shaped joint member. However, from a viewpoint of decreasing the number of parts, it is preferable that the rod-shaped connecting member be mounted on and integrally formed with the flat-plate-shaped joint member or the box-shaped joint member. A cross-sectional shape of the rod-shaped connecting member is not particularly limited, and as the cross-sectional shape of the rod-shaped connecting member, various shapes such as a circular shape, a rectangular shape, an arcuate shape, a polygonal shape can be adopted.

As a mode where the rod-shaped connecting member of the present invention is integrally formed with the flat-plate-shaped joint member or the box-shaped joint member, for example, a mode where the rod-shaped connecting member is mounted on a lower surface of the flat-plate-shaped joint member, and a mode where the rod-shaped connecting member is mounted on an upper surface of the box-shaped joint member can be named. In the former case, for example, the flat-plate-shaped joint member and the box-shaped joint member can be connected to each other by making the rod-shaped connecting member engage by fitting with a fitting engagement hole formed in an upper plate of the box-shaped joint member. In the latter case, for example, the flat-plate-shaped joint member and the box-shaped joint member can be connected to each other by making the rod-shaped connecting member engage by fitting with a fitting engagement recess formed on a lower surface of a flat surface portion of the flat-plate-shaped joint member. From a viewpoint more strongly connecting the flat-plate-shaped joint member and the box-shaped joint member to each other, the former mode is preferable. That is, the former mode is performed in a state where the rod-shaped connecting member having a certain length engages by fitting with the fitting engagement hole and hence, the connection between the flat-plate-shaped joint member and the box-shaped joint member is minimally released (the rod-shaped connecting member being minimally removed).

In a case where the rod-shaped connecting member of the present invention is a member separate from the flat-plate-shaped joint member and the box-shaped joint member, for example, the flat-plate-shaped joint member and the box-shaped joint member can be connected to each other by making one end of the rod-shaped connecting member engage by fitting with the fitting engagement recess formed on the flat-plate-shaped joint member and by making the other end of the rod-shaped connecting member engage by fitting with the fitting engagement hole formed in the box-shaped joint member.

It is preferable that a force (connecting force) for connecting the flat-plate-shaped joint member and the box-shaped joint member to each other by the rod-shaped connecting member of the present invention be stronger than a force (engaging force) making the projection of the flat-plate-shaped joint member and the recess of the box-shaped joint member engage with each other by fitting. That is, it is preferable that a frictional force generated between the rod-shaped connecting member and the fitting engagement hole and the like of the flat-plate-shaped joint member and/or the box-shaped joint member be larger than a frictional force generated between the projection of the flat-plate-shaped joint member and the recess of the box-shaped joint member. By setting the respective frictional forces as described above, in separating the blocks from each other, the blocks can be easily separated from each other without separating the members (the box-shaped block body, the flat-plate-shaped joint member, and the box-shaped joint member) which form the block.

The number of rod-shaped connecting members is not particularly limited, and can be suitably set depending on a size and a usage of the block. That is, one rod-shaped connecting member may be provided or a plurality of rod-shaped connecting members may be provided. A place where the rod-shaped connecting member is arranged is not particularly limited, and the rod-shaped connecting member can be arranged at a center, a corner or the like of a lower surface of the flat-plate-shaped joint member.

To be more specific, for example, a mode where two rod-shaped connecting members are formed on the lower surface of the flat-plate-shaped joint member, and a mode where one rod-shaped connecting member is formed on a corner of the lower surface of the flat-plate-shaped joint member can be named. In the former mode, the respective members, that is, the box-shaped block body, the flat-plate-shaped joint member, and the box-shaped joint member can be strongly integrally formed with each other. In the latter mode, the flat-plate-shaped joint member can be rotated in a horizontal direction about the rod-shaped connecting member and hence, in stacking another block on the block, another block can be stacked on the block in a state where a direction of another block can be freely changed (see FIG.

Figure 10:
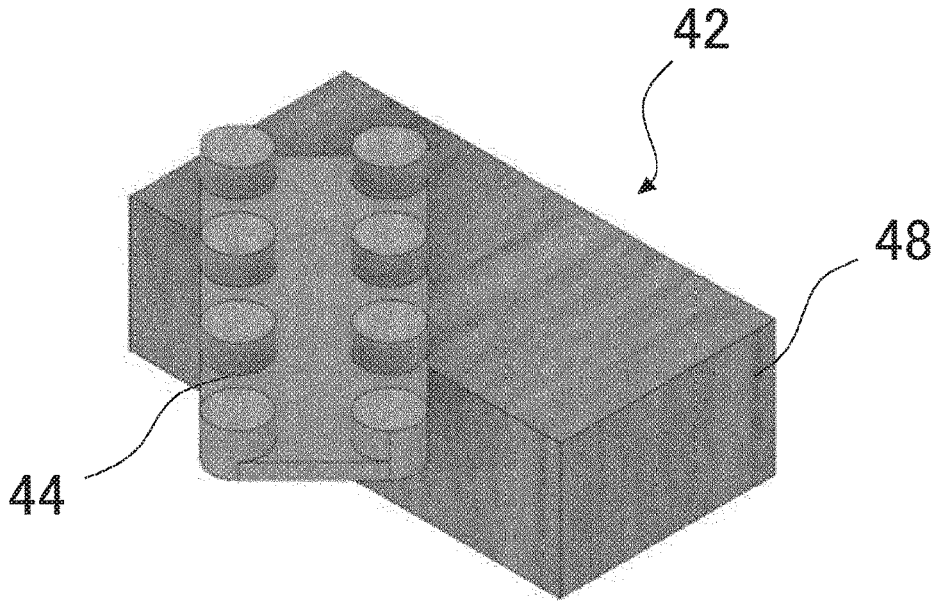
FIG. 10 is an explanatory view for describing an assembly where an angle between the blocks of the block member is changed from the corresponding angle set in FIG. 9 is changed, wherein (a) of FIG. 10 is an upper perspective view of one block where the block members are integrally formed with each other, and (b) of FIG. 10 is an upper perspective view after two blocks are assembled to each other.
Figure 10:
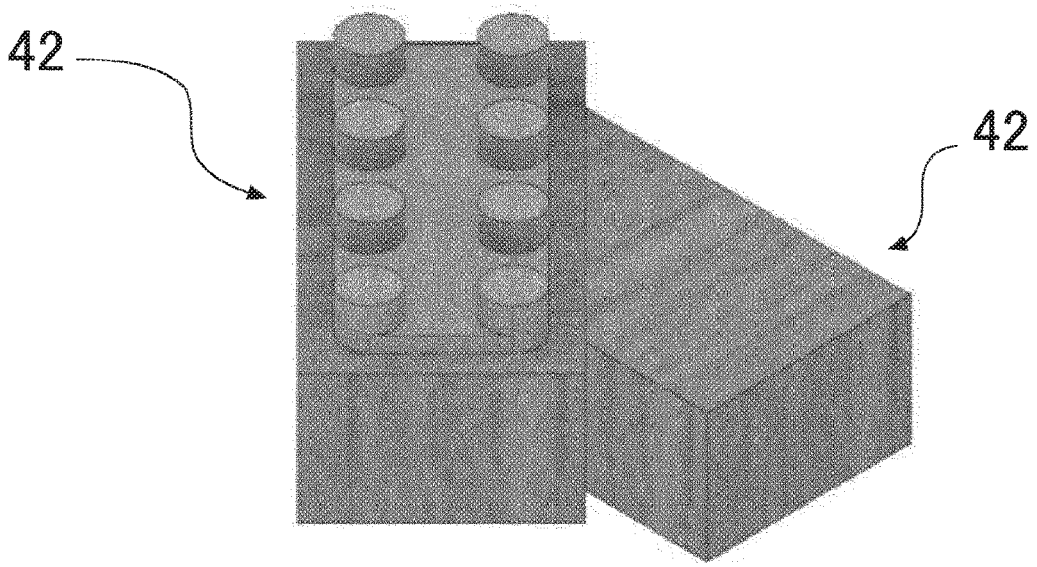

9 and FIG. 10). Further, in a case where a box-shaped block body which has a flat upper surface thus having no accommodating recess is used, neither an insertion hole nor an accommodating portion is not formed on an upper surface of a box-shaped block body which is exposed to the outside by the horizontal rotation of the flat-plate-shaped joint member and hence, the block member set can acquire excellent aesthetic appearance.

Embodiments of the block member set of the present invention are described in detail hereinafter with reference to drawings. However, the present invention is not limited to these embodiments.

Figure 2:
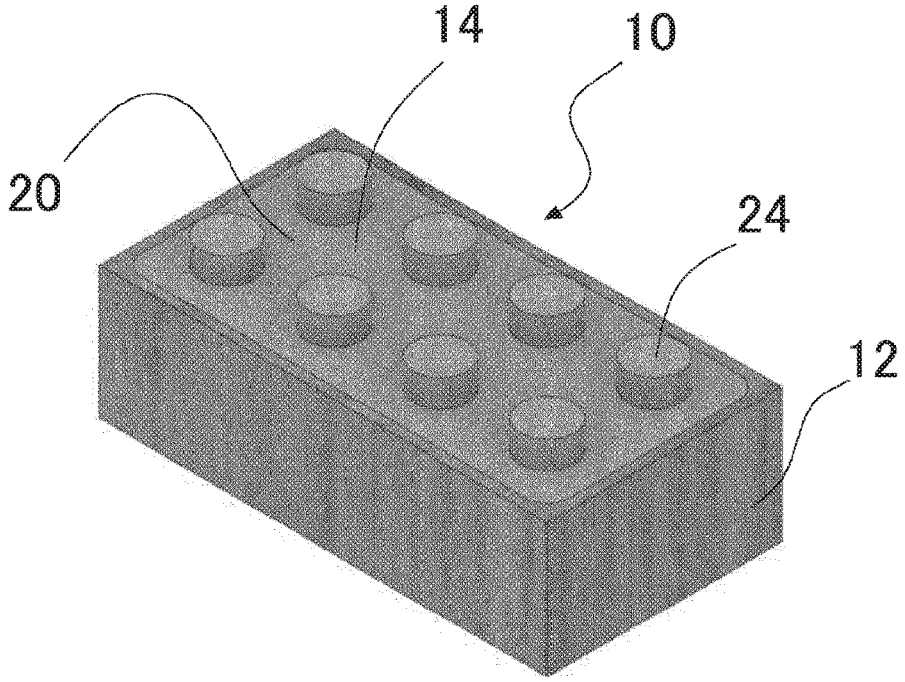
FIG. 2 is an explanatory view showing a state after the block members of the block member set according to the first embodiment are integrally formed with each other thus forming a block, wherein (a) of FIG. 2 is an upper perspective view, and (b) of FIG. 2 is a lower perspective view.
Figure 2:
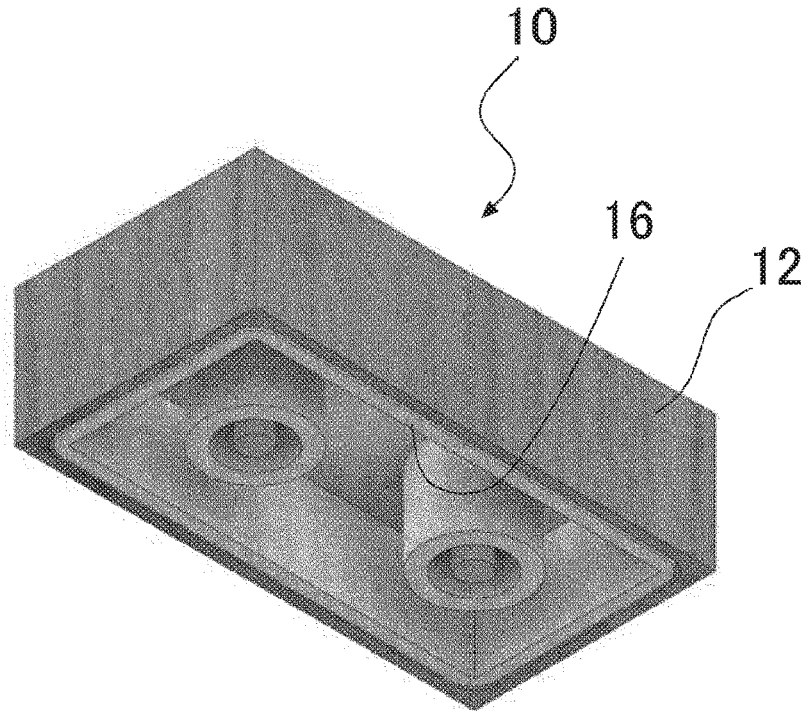
Figure 3:
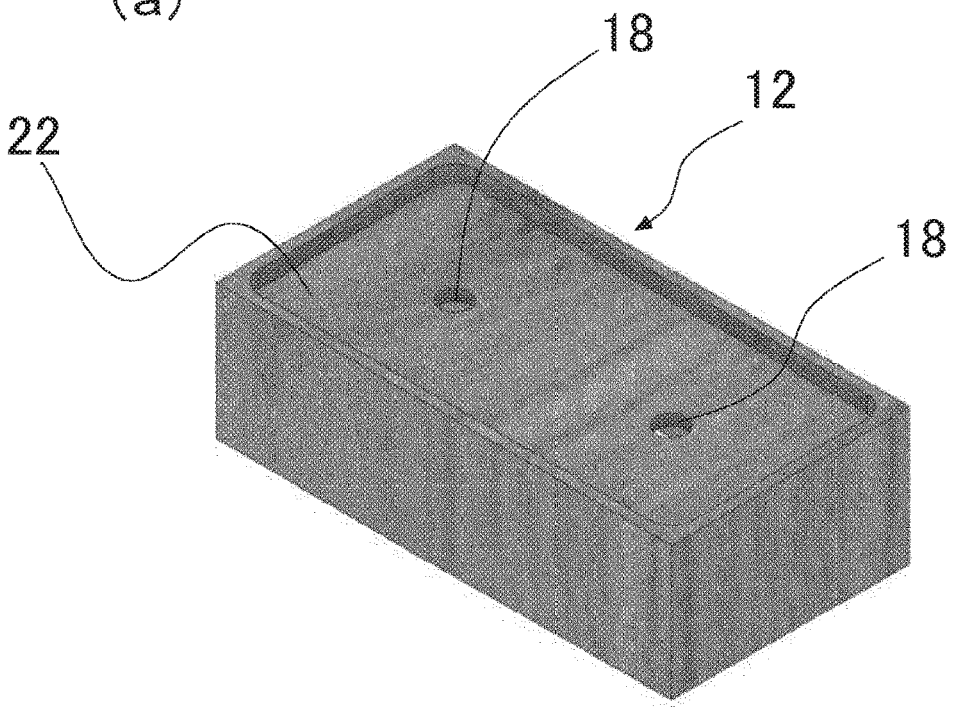
FIG. 3 is an explanatory view of a box-shaped block body of the block member set according to the first embodiment, wherein (a) of FIG. 3 is an upper perspective view, and (b) of FIG. 3 is a lower perspective view.
Figure 3:
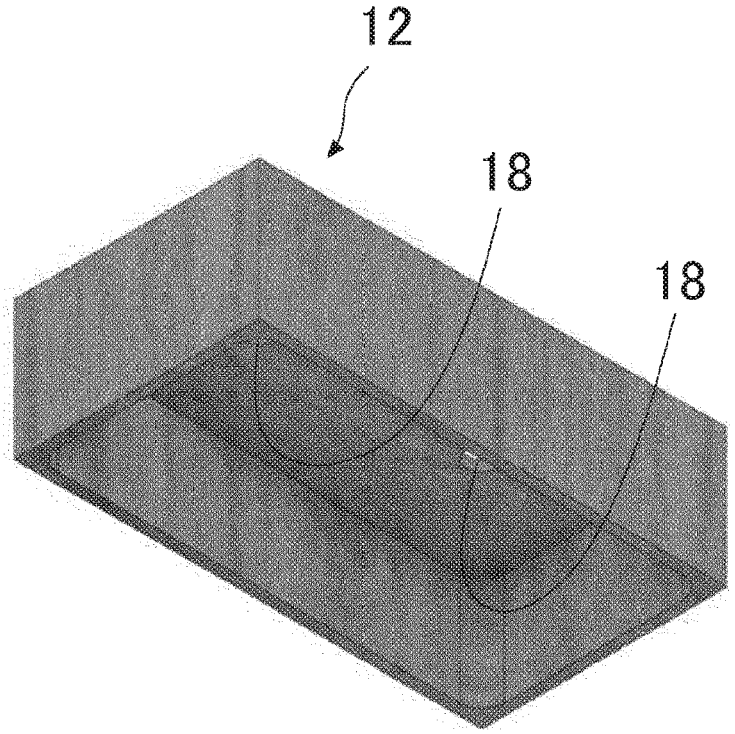
Figure 4:
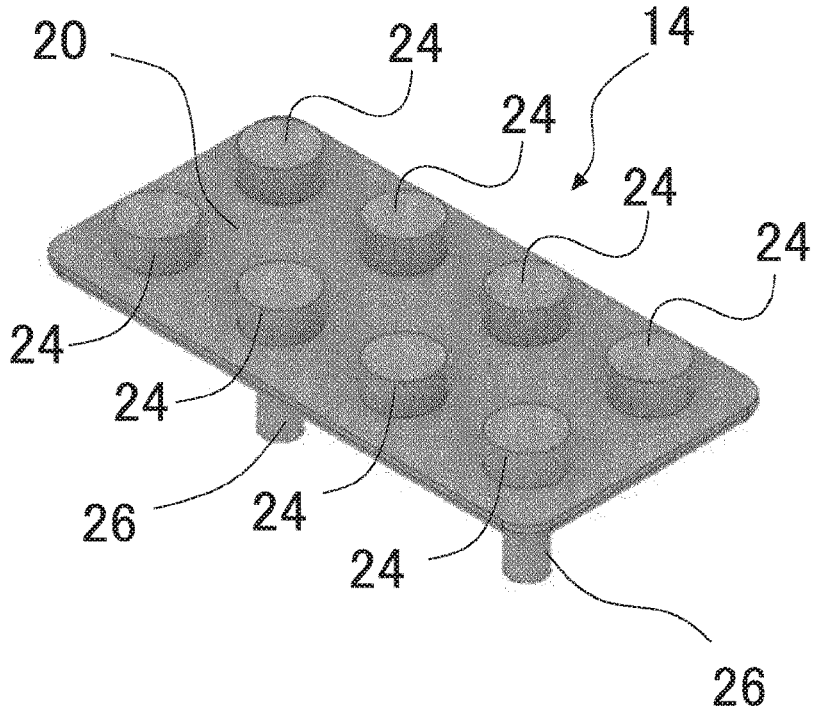
FIG. 4 is an explanatory view of a projection-attached flat-plate-shaped joint member of the block member set according to the first embodiment, wherein (a) of FIG. 4 is an upper perspective view, and (b) of FIG. 4 is a lower perspective view.
Figure 4:
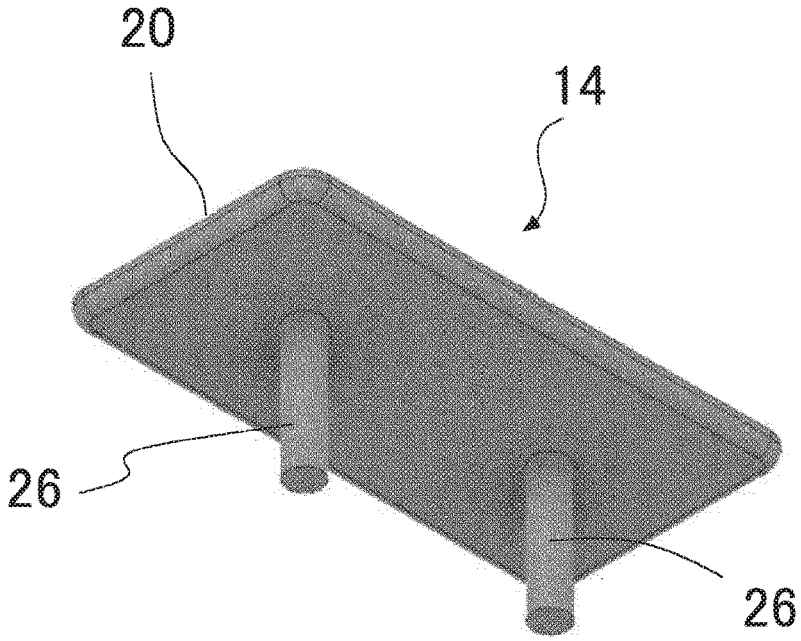
Figure 5:
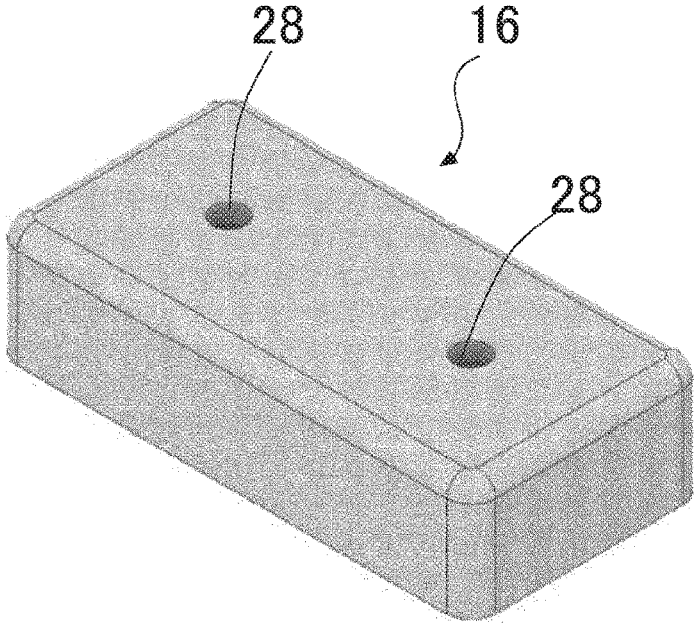
FIG. 5 is an explanatory view of a box-shaped recessed joint member of the block member set according to the first embodiment, wherein (a) of FIG. 5 is an upper perspective view, and (b) of FIG. 5 is a lower perspective view.
Figure 5:
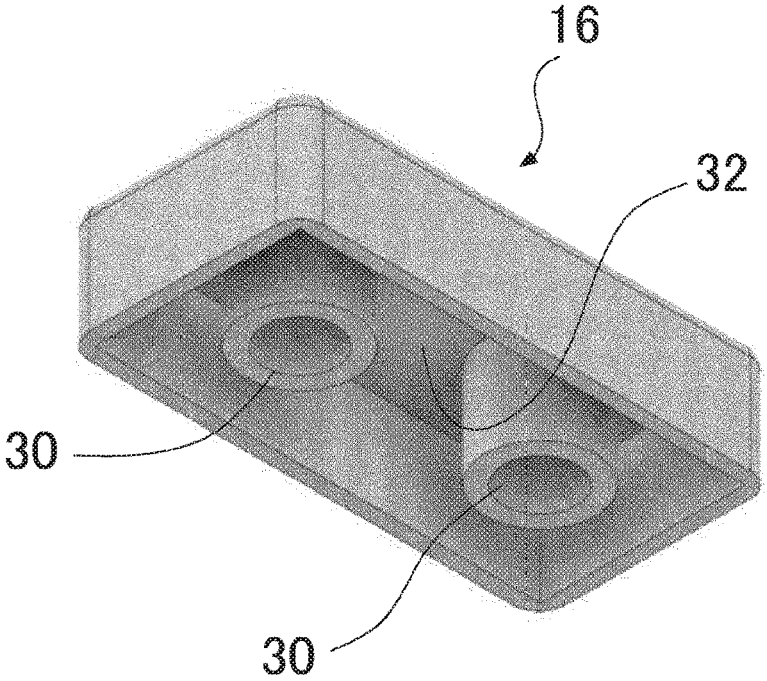
Figure 6:
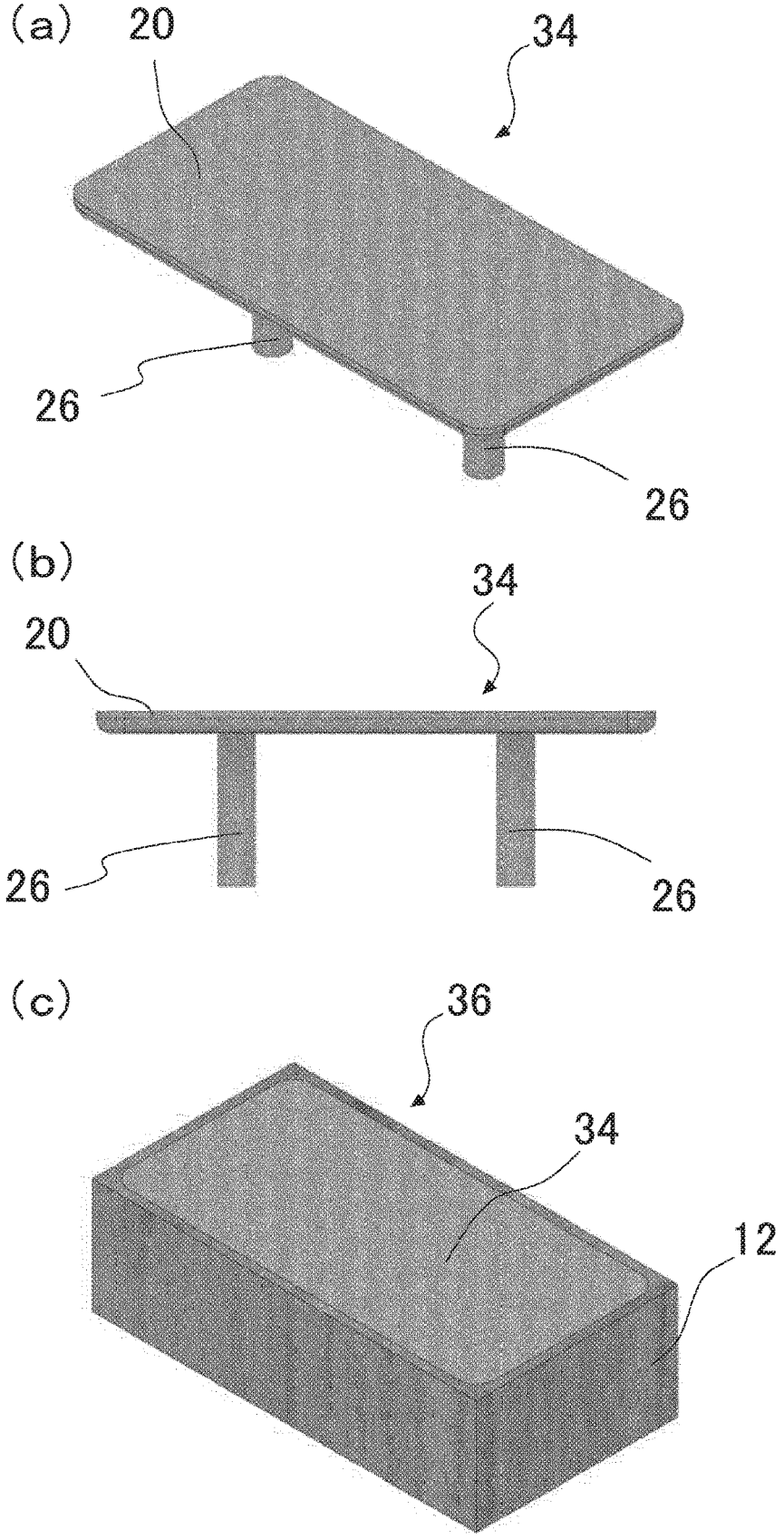
FIG. 6 is an explanatory view of a flat-plate-shaped planar joint member of the block member set according to the first embodiment, wherein (a) of FIG. 6 is an upper perspective view, (b) of FIG. 6 is a side view, and (c) of FIG. 6 is an upper perspective view of a block formed after the flat-plate-shaped planar joint member is integrally formed with the box-shaped block body and the box-shaped joint member.
Figure 7:
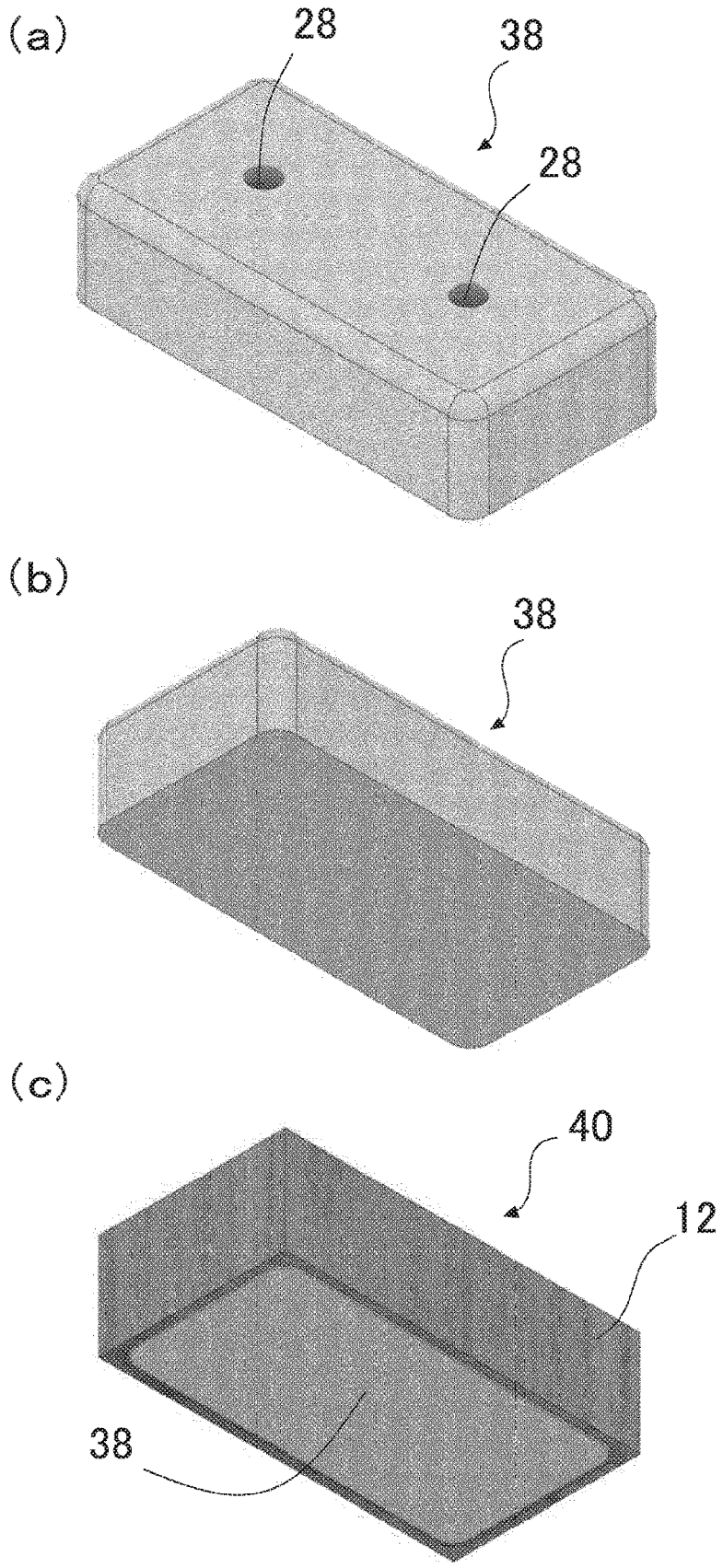
FIG. 7 is an explanatory view of a box-shaped planar joint member of the block member set according to the first embodiment, wherein (a) of FIG. 7 is an upper perspective view, (b) of FIG. 7 is a lower perspective view, and (c) of FIG. 7 is a lower perspective view of a block formed after the box-shaped planar joint member is integrally formed with the flat-plate-shaped joint member and the box-shaped block body.

In the drawings, FIG. 1 is a perspective view of block members in a block member set according to a first embodiment of the present invention (in a state before the block members are integrally formed so as to form a block). FIG. 2 is an explanatory view showing a state after the block members of the block member set according to the first embodiment are integrally formed with each other thus forming a block, wherein (a) of FIG. 2 is an upper perspective view and (b) of FIG. 2 is a lower perspective view. FIG. 3 is an explanatory view of a box-shaped block body of the block member set according to the first embodiment, wherein (a) of FIG. 3 is an upper perspective view and (b) of FIG. 3 is a lower perspective view. FIG. 4 is an explanatory view of a projection-attached flat-plate-shaped joint member of the block member set according to the first embodiment, wherein (a) of FIG. 4 is an upper perspective view and (b) of FIG. 4 is a lower perspective view. FIG. 5 is an explanatory view of a box-shaped recessed joint member of the block member set according to the first embodiment, wherein (a) of FIG. 5 is an upper perspective view and (b) of FIG. 5 is a lower perspective view. FIG. 6 is an explanatory view of a flat-plate-shaped planar joint member of the block member set according to the first embodiment, wherein (a) of FIG. 6 is an upper perspective view, (b) of FIG. 6 is a side view, and (c) of FIG. 6 is an upper perspective view of a block formed after the flat-plate-shaped planar joint member is integrally formed with the box-shaped block body and the box-shaped joint member. FIG. 7 is an explanatory view of a box-shaped planar joint member of the block member set according to the first embodiment, wherein (a) of FIG. 7 is an upper perspective view, (b) of FIG. 7 is a lower perspective view, and (c) of FIG. 7 is a lower perspective view of a block formed after the box-shaped planar joint member is integrally formed with the flat-plate-shaped joint member and the box-shaped block body.

As shown in FIG. 1, the block member set according to the first embodiment of the present invention includes a wooden box-shaped block body 12, a synthetic-resin-made projection-attached flat-plate-shaped joint member 14, and a synthetic-resin-made box-shaped recessed joint member 16.

As shown in FIG. 2, a block 10 formed by assembling the block members of the block member set according to the first embodiment is formed by integrally forming the box-shaped block body 12, the projection-attached flat-plate-shaped joint member 14, and the box-shaped recessed joint member 16 with each other.

As shown in FIG. 3, the box-shaped block body 12 is a wooden box body with an open bottom surface having a longitudinal size of approximately 50 mm, a lateral size of approximately 100 mm, and a height of approximately 30 mm. In an upper plate of the box-shaped block body 12, two insertion holes 18 into which connecting rods 26 (see FIG. 4) of the projection-attached flat-plate-shaped joint member 14 described later are inserted are formed. Further, on the upper surface of the box-shaped block body 12, an accommodating recess 22 having substantially the same size as a flat plate portion 20 (see FIG. 4) of the projection-attached flat-plate-shaped joint member 14 described later is formed. Accordingly, when the box-shaped block body 12 and the projection-attached flat-plate-shaped joint member 14 are assembled to each other, the upper surface can be formed into a flat surface having no stepped portion (see (a) of FIG. 2).

As shown in FIG. 4, the projection-attached flat-plate-shaped joint member 14 has the flat plate portion 20 having a longitudinal size of approximately 46 mm, a lateral size of approximately 96 mm, and a thickness of approximately 3 mm. On an upper portion of the projection-attached flat-plate-shaped joint member 14, eight circular-columnar-shaped projections 24 having a circular columnar shape in total are formed. The circular-columnar-shaped projections 24 are arranged side by side in two rows, and four circular-columnar-shaped projections 24 are arranged in each row. Two circular-columnar-shaped connecting rods 26 are mounted on a center of a lower surface of the projection-attached flat-plate-shaped joint member 14. The connecting rods 26 are arranged corresponding to the insertion holes 18 formed in the box-shaped block body 12.

As shown in FIG. 5, the box-shaped recessed joint member 16 is a box body with an open bottom surface having a longitudinal size of approximately 45 mm, a lateral size of approximately 95 mm, and a height of approximately 25 mm. In an upper plate of the box-shaped recessed joint member 16, two fitting engagement holes 28 which engage by fitting with the connecting rods 26 of the projection-attached flat-plate-shaped joint member 14 are formed. Since the connecting rods 26 of the projection-attached flat-plate-shaped joint member 14 engage by fitting with the fitting engagement holes 28 through the insertion holes 18 formed in the box-shaped block body, the box-shaped block body 12, the projection-attached flat-plate-shaped joint member 14, and the box-shaped recessed joint member 16 are integrally formed with each other.

In the box-shaped recessed joint member 16, two cylindrical partition portions 30 each having a cylindrical shape are disposed as partition portions. Recess spaces (inner spaces) 32 are formed between outer peripheral surfaces of the cylindrical partition portions 30 and an inner side surface of the box-shaped recessed joint member 16. The recess spaces 32 are formed in a shape which makes the circular-columnar-shaped projections 24 engage with the recess spaces 32 by fitting. In assembling the blocks 10 to each other, the circular-columnar-shaped projections 24 formed on the projection-attached flat-plate-shaped joint member 14 of another block 10 engage with the recess spaces 32 of one block 10 by fitting. Inner cavities of the cylindrical partition portions 30 communicate with the fitting engagement holes 28, and the connecting rods 26 are accommodated in the cylindrical partition portions 30.

As shown in FIG. 6, the flat-plate-shaped joint member in the block member set according to the first embodiment includes a flat-plate-shaped planar joint member 34 having no projection (circular-columnar-shaped projection) on an upper surface of the flat-plate-shaped planar joint member 34 besides the projection-attached flat-plate-shaped joint member 14.

The flat-plate-shaped planar joint member 34 has substantially the same configuration as the projection-attached flat-plate-shaped joint member 14 except for a point that the flat-plate-shaped planar joint member 34 has no circular-columnar-shaped projection 24 on the upper surface of the flat-plate-shaped planar joint member 34 and the upper surface of the flat-plate-shaped planar joint member 34 is a flat surface. The upper surface of the flat-plate-shaped planar joint member 34 is a flat surface and hence, it is possible to form a block 36 where projections do not appear on an outer surface ((c) of FIG. 6). By arranging the block 36 (flat-plate-shaped planar joint member 34) on an outer surface of a structural body manufactured by assembling the blocks 10 to each other, it is possible to provide a structural body having excellent aesthetic appearance.

As shown in FIG. 7, the box-shaped joint member in the block member set according to the first embodiment includes a box-shaped planar joint member 38 having a flat lower surface besides the box-shaped recessed joint member 16.

The box-shaped planar joint member 38 has substantially the same configuration as the box-shaped recessed joint member 16 except for a point that the recess space 32 is not exposed to an outer surface, and a lower surface of the box-shaped planar joint member 38 is a flat surface. The lower surface of the box-shaped planar joint member 38 is a flat surface and hence, it is possible to form a block 40 where a recess does not appear on an outer surface ((c) of FIG. 7). By arranging the block 40 (the box-shaped planar joint member 38) on an outer surface of a structural body manufactured by assembling the blocks 10 to each other, it is possible to provide a structural body having excellent appearance.

Figure 8:
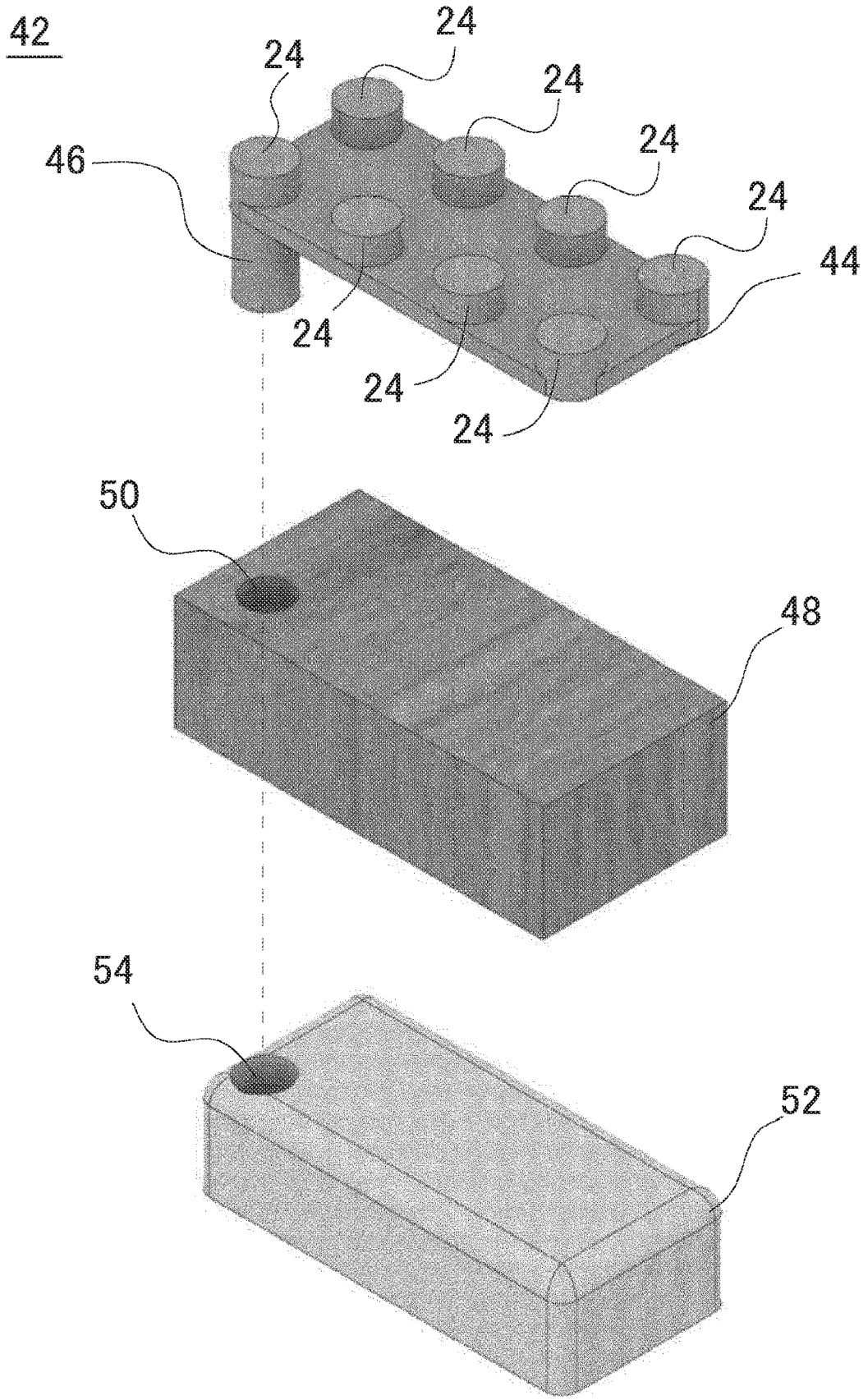
FIG. 8 is a perspective view of block members of a block member set according to a second embodiment of the present invention (a state before the block members are integrally formed so as to form a block), and is an explanatory view of an embodiment where one rod-like connecting member is formed on a corner of a flat-plate-shaped joint member.
Figure 9:
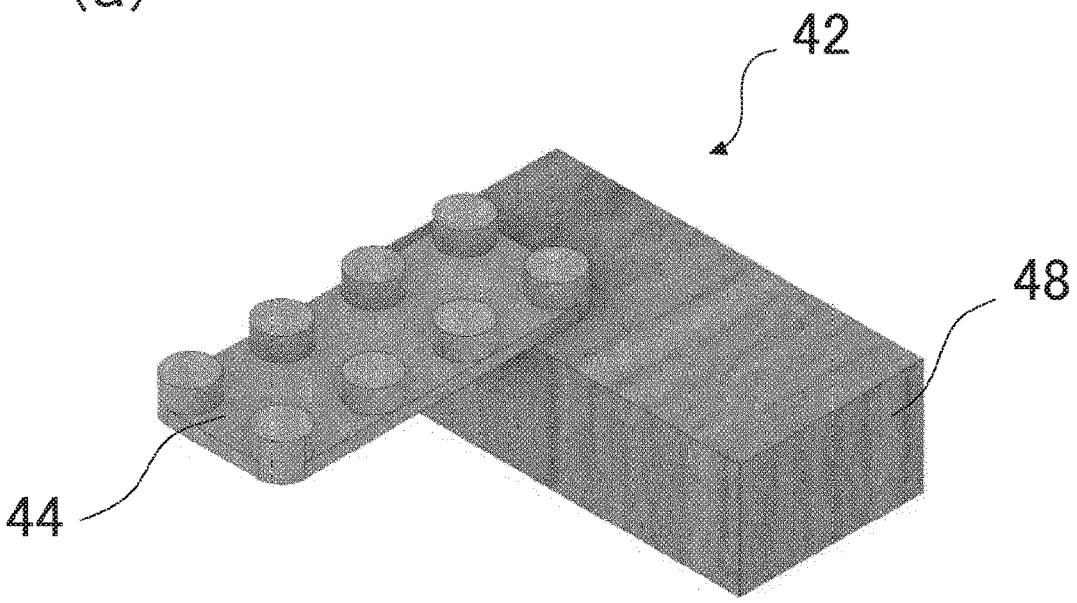
FIG. 9 is an explanatory view for describing an assembly using blocks of the block member set according to the second embodiment, wherein (a) of FIG. 9 is an upper perspective view of one block where block members are integrally formed with each other, and (b) of FIG. 9 is an upper perspective view after two blocks are assembled to each other.
Figure 9:
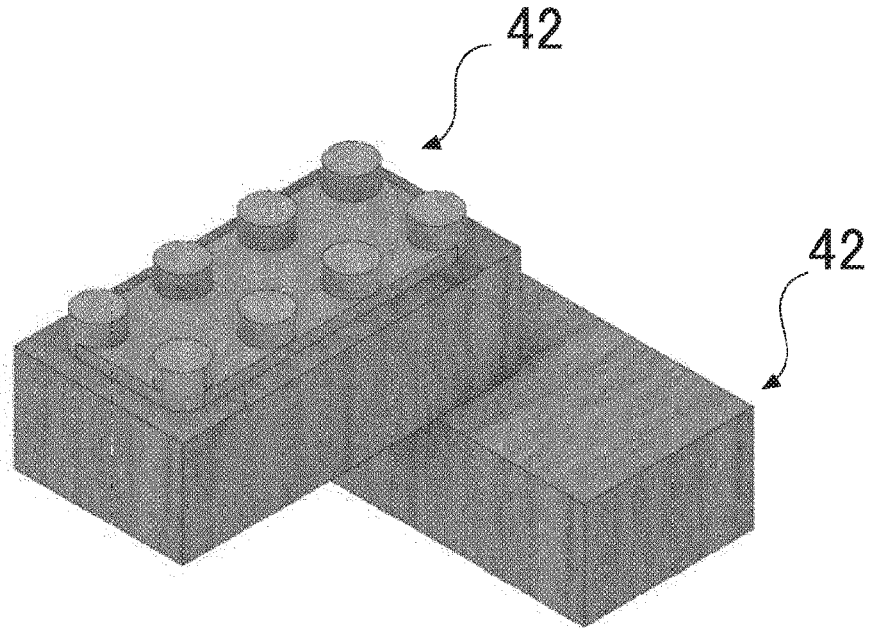
Figure 11:
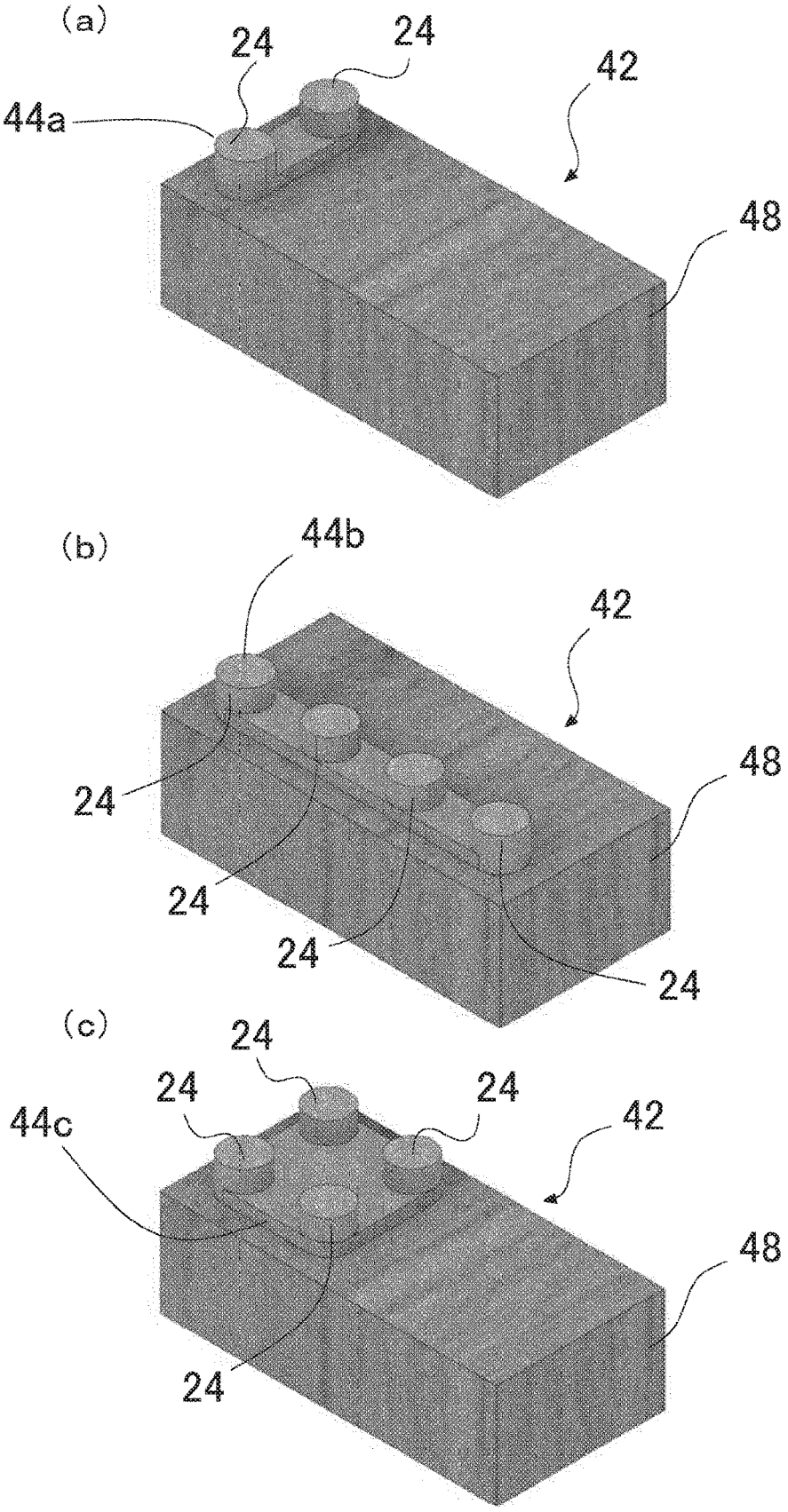
FIG. 11 is an explanatory view of blocks where the number of projections of the flat-plate-shaped joint member of the block member set according to the second embodiment is changed.
Figure 12:
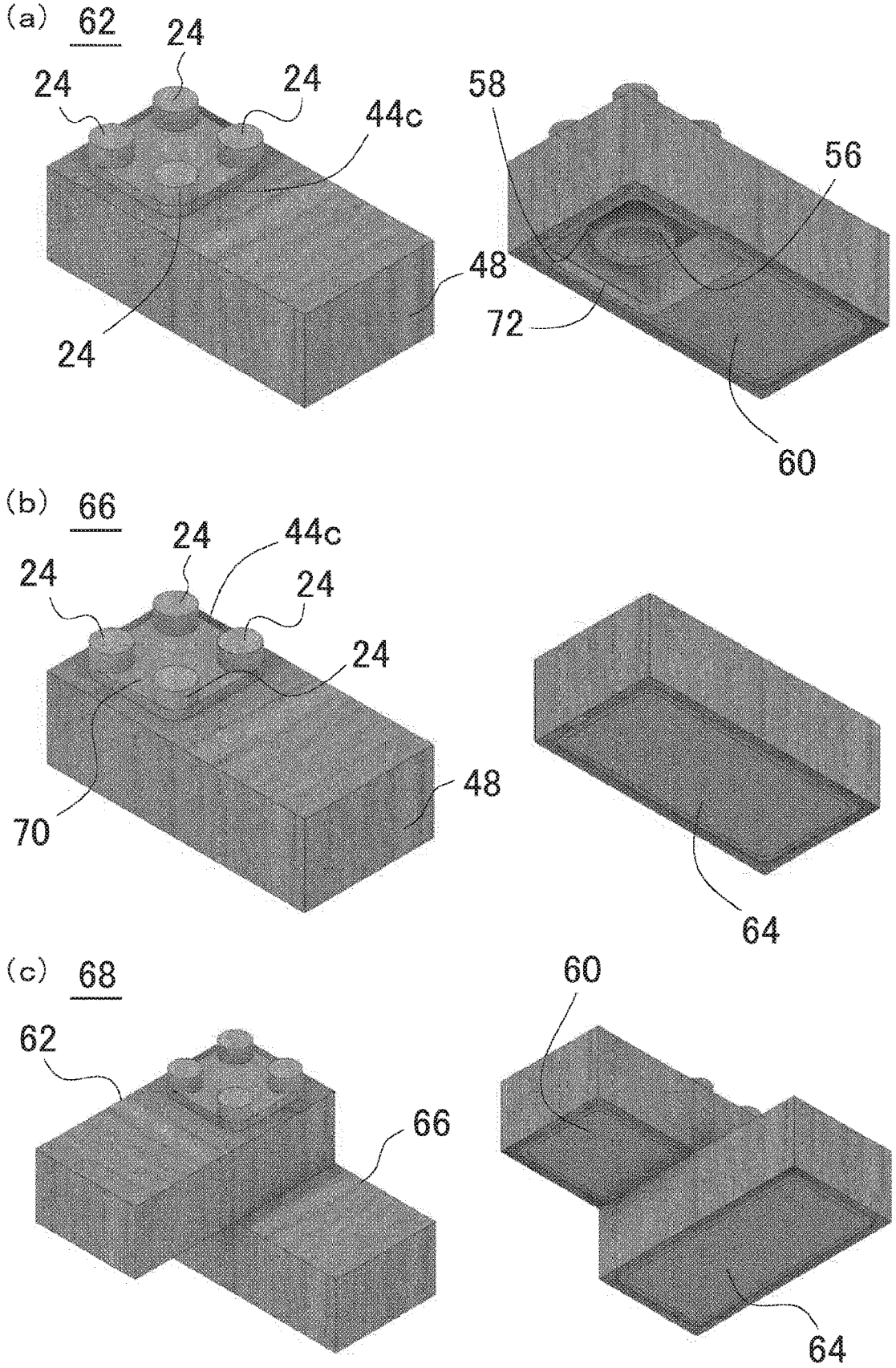
FIG. 12 is an explanatory view in a case where blocks of the block member set according to the second embodiment are assembled to each other, wherein (a) and (b) of FIG. 12 are perspective views of the respective blocks before being assembled to each other, and (c) of FIG. 12 is a view for describing a state after the blocks shown in (a) and (b) of FIG. 12 are assembled to each other.
Figure 13:
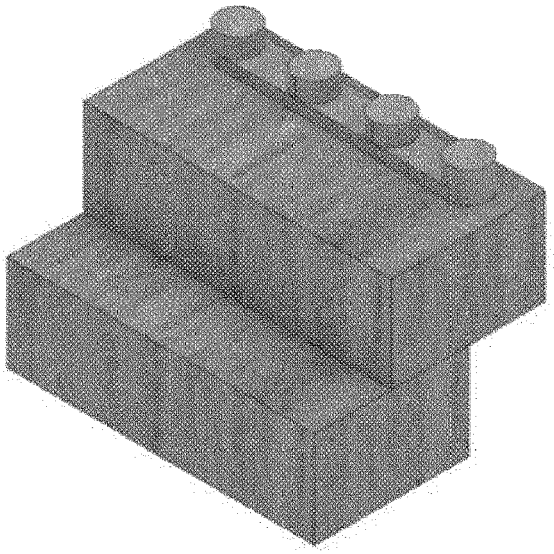
FIG. 13 is an explanatory view showing assembling examples of the blocks of the block member set of the present invention.
Figure 13:
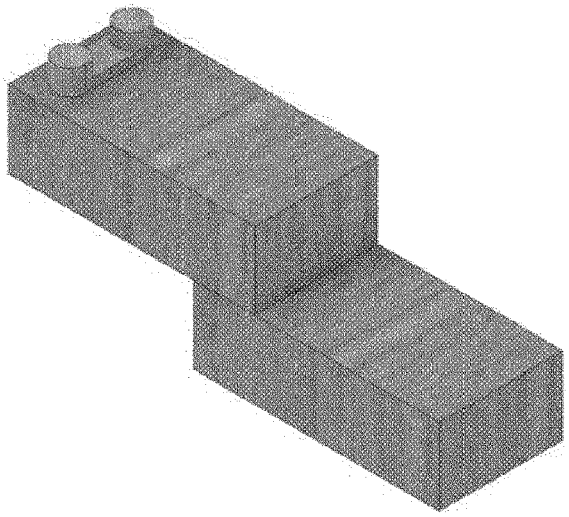
Figure 13:
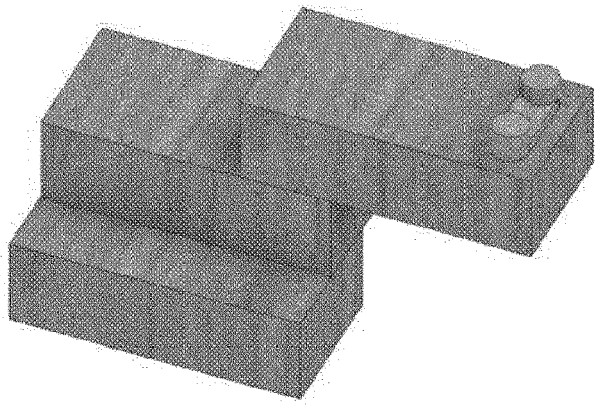

Subsequently, a block 42 of a block member set according to a second embodiment of the present invention is described. FIG. 8 is a perspective view of block members of the block member set according to the second embodiment of the present invention (in a state before the block members are integrally formed so as to form a block). FIG. 8 is also an explanatory view of an embodiment where one rod-shaped connecting member is formed on a corner of a flat-plate-shaped joint member. FIG. 9 is an explanatory view for describing an assembly formed using blocks of the block member set according to the second embodiment, wherein (a) of FIG. 9 is an upper perspective view of one block where the block members are integrally formed with each other, and (b) of FIG. 9 is an upper perspective view after two blocks are assembled to each other. FIG. 10 is an explanatory view for describing an assembly where an angle formed between the blocks of the block member set is changed from the corresponding angle set in FIG. 9, wherein (a) of FIG. 10 is an upper perspective view of one block where the block members are integrally formed with each other, and (b) of FIG. 10 is an upper perspective view after two blocks are assembled to each other. FIG. 11 is an explanatory view of blocks where the number of projections of the flat-plate-shaped joint member of the block member set according to the second embodiment is changed. FIG. 12 is an explanatory view in a case where blocks of the block member set according to the second embodiment are assembled to each other, wherein (a) and (b) of FIG. 12 are perspective views of the respective blocks before the blocks are assembled to each other, and (c) of FIG. 12 is a view for describing a state after the blocks shown in (a) and (b) of FIG. 12 are assembled to each other. FIG. 13 is an explanatory view showing assembly examples of the blocks of the block member set of the present invention.

The block 42 of this embodiment has substantially the same configuration as the block 10 according to the above-mentioned one embodiment except for a point that one rod-shaped connecting member is formed on one corner of the flat-plate-shaped joint member and, at the same time, an insertion hole and a fitting engagement hole are formed in the box-shaped block body and the box-shaped joint member respectively corresponding to the rod-shaped connecting member, and a point that the box-shaped block body does not have an accommodating recess 22.

As shown in FIG. 8, the projection-attached flat-plate-shaped joint member 44 includes one connecting rod 46 on a corner of a lower surface of a flat plate portion. A box-shaped block body 48 has one insertion hole 50 at a position corresponding to the connecting rod 46 of the projection-attached flat-plate-shaped joint member 44. A box-shaped recessed joint member 52 has one fitting engagement hole 54 at a position corresponding to the connecting rod 46 of the projection-attached flat-plate-shaped joint member 44. As shown in (a) of FIG. 9, the projection-attached flat-plate-shaped joint member 44 and the box-shaped recessed joint member 52 accommodated in the box-shaped block body 48 are connected to each other by the connecting rod 46 and are integrally formed with each other thus forming the block 42.

As shown in FIG. 9 and FIG. 10, in the block 42, the projection-attached flat-plate-shaped joint member 44 is rotatable in a horizontal direction about the connecting rod 46. Accordingly, at the time of manufacturing a structural body by assembling the blocks 42 to each other, the blocks 42 can be assembled to each other in a state where an angle between the blocks 42 can be freely changed. Further, an upper surface of the box-shaped block body 48 which is exposed to the outside because of the rotation is a surface with wood-grain pattern in which neither the insertion hole 50 nor the accommodating recess 22 are formed, and a lower surface of the projection-attached flat-plate-shaped joint member 44 is also a flat surface. Accordingly, it is possible to provide a structural body having excellent appearance.

As shown in FIG. 11, in the projection-attached flat-plate-shaped joint member 44 of the block 42 of this embodiment, the number of projections (circular-columnar-shaped projections 24) can be changed when necessary. That is, the number of projections (circular-columnar-shaped projections 24) can be suitably set depending on a size and a usage of the block member set. For example, a projection-attached flat-plate-shaped joint member 44*a* has two circular-columnar-shaped projections 24 in total where two circular-columnar-shaped projections 24 are arranged in a row in a longitudinal direction and one projection 24 is arranged in a lateral direction. A projection-attached flat-plate-shaped joint member 44*b* has four circular-columnar-shaped projections 24 in total where four circular-columnar-shaped projections 24 are arranged in a row in a lateral direction and one projection 24 is disposed in a longitudinal direction. A projection-attached flat-plate-shaped joint member 44*c* has four circular-columnar-shaped projections 24 in total where two circular-columnar-shaped projections 24 are arranged in a row in a longitudinal direction and two projections 24 are arranged in a row in a lateral direction. With such a configuration, a flat surface of the upper surface of the box-shaped block body 48 can be exposed to the outside without unnecessarily exposing the projections thus effectively using a wood-grain pattern of the upper surface of the box-shaped block body 48.

To be more specific, for example, as shown in FIG. 12, it is possible to provide a structural body 68 where the exposure of projections and recesses is small ((c) of FIG. 12) by assembling: a block 62 ((a) of FIG. 12) which uses a box-shaped recessed joint member 60 where recess spaces 58 are formed in one half of the box-shaped recessed joint member 60 by a cylindrical partition portion 56 and an inner side surface of the box-shaped recessed joint member 60 and the remaining half of the box-shaped recessed joint member 60 is formed into a flat surface; and a block 66 ((b) of FIG. 12) which uses the projection-attached flat-plate-shaped joint member 44*c* having projections corresponding to the recess spaces; and a box-shaped planar joint member 64 having a flat lower surface to each other. A lower peripheral edge 72 of the box-shaped recessed joint member 60 of the block 62 is set lower in height than the box-shaped block body 48 such that the lower peripheral edge 72 can accommodate a flat plate portion 70 of the projection-attached flat-plate-shaped joint member 44*c* formed on the upper surface of the box-shaped block body 48 of the block 42. With such a configuration, the blocks can be stacked on each other without forming a gap. Further, lower surfaces of the block 62 and the block 66 which are viewed when these blocks 62, 66 are stacked are formed of a flat surface respectively and hence, it is possible to provide a structural body of a design having excellent aesthetic external appearance where a fact that the structural body is manufactured by the blocks cannot be recognized at a glance.

Further, as shown in FIG. 13, the block member set according to the present invention can be assembled with various blocks.

Figure 14:
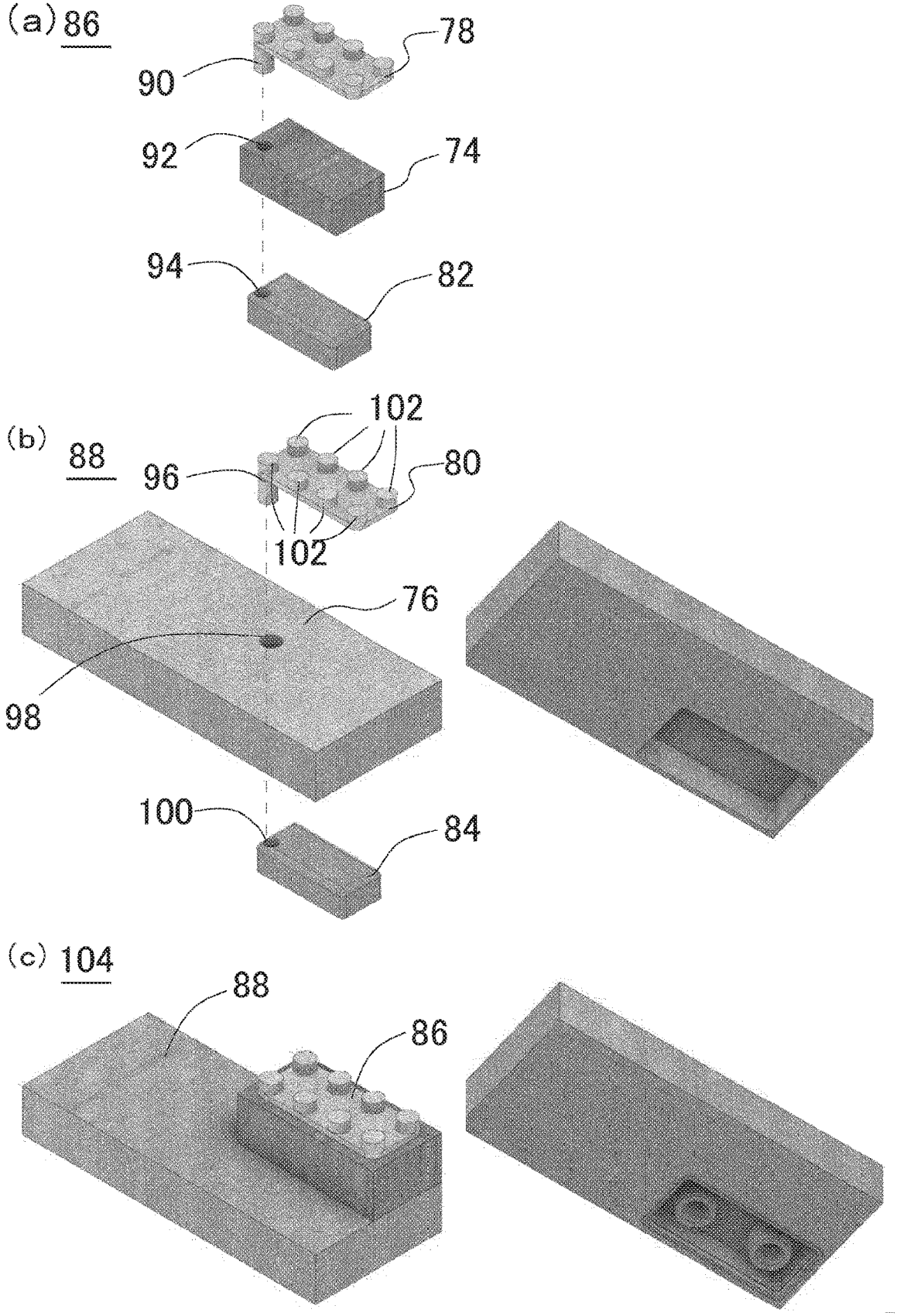
FIG. 14 is an explanatory view showing use examples of the block member set of the present invention, wherein (a) and (b) of FIG. 14 are perspective views of block members for forming blocks which differ from each other in size, and (c) of FIG. 14 is a perspective view of a structural body after the blocks which differ from each other in size are assembled to each other.
Figure 15:
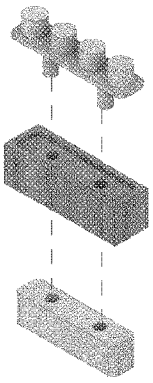
FIG. 15 is an explanatory view showing other use examples of the block member set of the present invention, wherein (a) and (b) of FIG. 15 are perspective views of block members for forming blocks which differ from each other in size, and (c) of FIG. 15 is a perspective view of a structural body after the blocks which differ from each other in size are assembled to each other.
Figure 15:
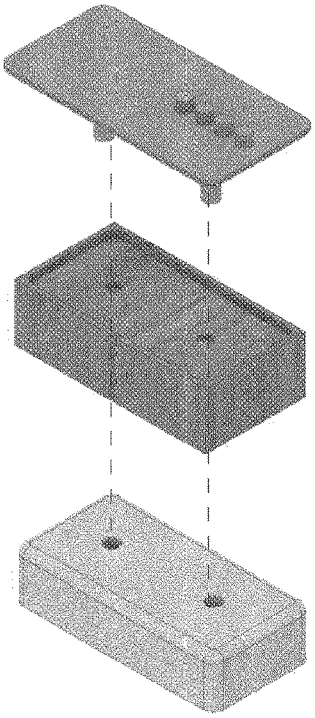
Figure 15:
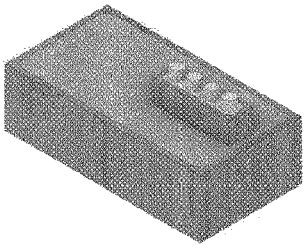

Next, other assembly examples of blocks using the block member set of the present invention are described. FIG. 14 is an explanatory view showing a use example of the block member set of the present invention, wherein (a) and (b) of FIG. 14 are perspective views of block members for forming blocks which differ from each other in size, and (c) of FIG. 14 is a perspective view of a structural body after the blocks which differ from each other in size are assembled to each other. FIG. 15 is an explanatory view showing another use example of the block member set of the present invention, wherein (a) and (b) of FIG. 15 are perspective views of block members for forming blocks which differ from each other in size, and (c) of FIG. 15 is a perspective view of a structural body after the blocks which differ from each other in size are assembled to each other.

In this embodiment, as shown in FIG. 14, the description is made with respect to a method of assembling: a block 86 ((a) of FIG. 14) which is formed by integrally forming three members in total consisting of a box-shaped block body 74, a projection-attached flat-plate-shaped joint member 78 and a box-shaped recessed joint member 82 with each other: and a block 88 ((b) of FIG. 14) which is formed by integrally forming three members in total consisting of a box-shaped block body 76 having the same height as the box-shaped block body 74 and having longer widths (a longitudinal width and a lateral width) than corresponding widths of the box-shaped block body 74, a projection-attached flat-plate-shaped joint member 80 having the same shape as the projection-attached flat-plate-shaped joint member 78, and a box-shaped recessed joint member 84 having the same shape as the box-shaped recessed joint member 82 with each other.

As shown in FIG. 14, a connecting rod 90 of the projection-attached flat-plate-shaped joint member 78 is made to engage by fitting with a fitting engagement hole 94 of the box-shaped recessed joint member 82 through an insertion hole 92 formed in an upper surface of the box-shaped block body 74 and hence, the projection-attached flat-plate-shaped joint member 78, the box-shaped block body 74 and the box-shaped recessed joint member 82 are integrally formed with each other thus forming the block 86. Further, a connecting rod 96 of the projection-attached flat-plate-shaped joint member 80 engages by fitting with a fitting engagement hole 100 formed in an upper surface of the box-shaped recessed joint member 84 through an insertion hole 98 of the box-shaped block body 76 and hence, the projection-attached flat-plate-shaped joint member 80, the box-shaped block body 76 and the box-shaped recessed joint member 84 are integrally formed with each other thus forming the block 88.

Then, a structural body 104 is manufactured by making circular-columnar-shaped projections 102 of the projection-attached flat-plate-shaped joint member 80 of the block 88 engage with recessed spaces (not shown in the drawing) in the box-shaped recessed joint member 82 of the block 86 by fitting ((c) of FIG. 14). In this manner, according to the block member set of the present invention, structural bodies having various shapes can be manufactured using the box-shaped block bodies which differ from each other in size and the projection-attached flat-plate-shaped joint members having the same shape and the box-shaped recessed joint members respectively having the same shape. In the same manner, as shown in FIG. 15, according to the block member set of the present invention, structural bodies of various shapes can be manufactured using projection-attached flat-plate-shaped joint members of various shapes and box-shaped recessed joint members of various shapes.

INDUSTRIAL APPLICABILITY

The block member set of the present invention can be used for manufacturing interior articles, gardening tools, furniture and the like in addition to toys. Accordingly, the block member set of the present invention is industrially useful.

REFERENCE SIGNS LIST

10 block
12 box-shaped block body
14 projection-attached flat-plate-shaped joint member
16 box-shaped recessed joint member
18 insertion hole
20 flat plate portion
22 accommodating recess
24 circular-columnar-shaped projection
26 connecting rod
28 fitting engagement hole
30 cylindrical partition portion
32 recess space (inner space)
34 flat-plate-shaped planar joint member
36 block
38 box-shaped planar joint member
40 block
42 block
44 projection-attached flat-plate-shaped joint member
46 connecting rod
48 box-shaped block body
50 insertion hole
52 box-shaped recessed joint member
54 fitting engagement hole
56 cylindrical partition portion
58 recess space (inner space)
60 box-shaped recessed joint member
62 block
64 box-shaped planar joint member
66 block
68 structural body
70 flat plate portion
72 lower peripheral edge
74 box-shaped block body

76 box-shaped block body
78 projection-attached flat-plate-shaped joint member
80 projection-attached flat-plate-shaped joint member
82 box-shaped recessed joint member
84 box-shaped recessed joint member
86 block
88 block
90 connecting rod
92 insertion hole
94 fitting engagement hole
96 connecting rod
98 insertion hole
100 fitting engagement hole
102 circular-columnar-shaped projection
104 structural body

The invention claimed is:

1. A toy block member set comprising:

a plurality of box-shaped block bodies each including an open bottom surface, a plurality of flat-plate-shaped joint members, each including at least one rod-shaped connecting member provided on a lower surface of a respective one of the plurality of flat-plate-shaped joint members, and a plurality of box-shaped joint members, each being configured to be entirely accommodated in each of the plurality of box-shaped block bodies, wherein each of the plurality of flat-plate-shaped joint members placed on an upper surface of each of the plurality of box-shaped block bodies and each of the plurality of box-shaped joint members accommodated in each of the box-shaped block bodies are connected to each other by the at least one rod-shaped connecting member of each of the flat-plate-shaped joint members which passes through an insertion hole provided in each of the box-shaped block bodies, such that each of the box-shaped block bodies, the flat-plate-shaped joint members and the box-shaped joint members are integrally formed with each other to form one block of a plurality of blocks, wherein at least one of the plurality of flat-plate-shaped joint members is a projection-attached flat-plate-shaped joint member including a projection on an upper surface of the projection-attached flat-plate-shaped joint member, and at least one of the plurality of the box-shaped joint members is a box-shaped recessed joint member which includes an open bottom surface and includes a recess which engages, by fitting, with the projection of the projection-attached flat-plate-shaped joint member of another one of the plurality of blocks.

2. The block member set according to claim 1, wherein the at least one rod-shaped connecting member of each of the flat-plate-shaped joint members is made to engage by fitting with and to be fixed to a fitting engagement hole provided in each of the box-shaped joint members, where each of the box-shaped bodies, the flat-plate-shaped joint members and the box-shaped joint members are integrally formed with each other.

3. The block member set according to claim 2, wherein two rod-shaped connecting members are provided on the lower surface of each of the flat-plate-shaped joint members.

4. The block member set according to claim 2, wherein one rod-shaped connecting member is provided on a corner of the lower surface of each of the flat-plate-shaped joint members.

5. The block member set according to claim 4, wherein two or more insertion holes are provided in corners of an upper plate of each of the box-shaped block bodies, and two or more fitting engagement holes are provided in corners of an upper plate of each of the box-shaped joint members.

6. The block member set according to claim 1, wherein at least one of the plurality of flat-plate-shaped joint members is a flat-plate-shaped planar joint member including a completely flat upper surface.

7. The block member set according to claim 1, wherein at least one of the plurality of box-shaped joint members is a box-shaped planar joint member including a completely flat lower surface.

8. The block member set according to claim 1, wherein an accommodating recess which accommodates a flat plate portion of each of the flat-plate-shaped joint members is formed on an upper surface of each of the box-shaped block bodies.

9. The block member set according to claim 1, wherein each of the box-shaped block bodies and the box-shaped joint members are shaped so as to accommodate the flat-plate-shaped joint member disposed on an upper surface of one block in an other block, in assembling the other block to an upper portion of the one block by stacking.

10. The block member set according to claim 1, wherein the box-shaped block bodies are made from wood.

11. The block member set according to claim 1, wherein the flat-plate-shaped joint members and the box-shaped joint members are made from a synthetic resin.

12. A toy block comprising:

a box-shaped block body including an open bottom surface, a flat-plate-shaped joint member including at least one rod-shaped connecting member provided on a lower surface of the flat-plate-shaped joint member, and a box-shaped joint member which is entirely accommodated in the box-shaped block body, wherein the flat-plate-shaped joint member placed on an upper surface of the box-shaped block body and the box-shaped joint member accommodated in the box-shaped block body are connected with each other by the at least one rod-shaped connecting member of the flat-plate-shaped joint member which passes through at least one insertion hole provided in the box-shaped block body, such that the box-shaped block body, the flat-plate-shaped joint member and the box-shaped joint member are integrally formed with each other.

* * * * *